US007350467B2

(12) United States Patent
Green et al.

(10) Patent No.: US 7,350,467 B2
(45) Date of Patent: Apr. 1, 2008

(54) LONG RAIL PICK-UP AND DELIVERY SYSTEM

(75) Inventors: Martin Green, St. Louis Park, MN (US); David Huebner, Mound, MN (US)

(73) Assignee: Loram Maintenance of Way, Inc., Hamel, MN (US)

( * ) Notice: Subject to any disclaimer, the term of this patent is extended or adjusted under 35 U.S.C. 154(b) by 32 days.

(21) Appl. No.: 11/209,188

(22) Filed: Aug. 22, 2005

(65) Prior Publication Data

US 2006/0102042 A1 May 18, 2006

Related U.S. Application Data

(60) Provisional application No. 60/603,200, filed on Aug. 20, 2004.

(51) Int. Cl.
*E01B 27/17* (2006.01)

(52) U.S. Cl. ..... 104/7.1

(58) Field of Classification Search ..... 104/2, 104/4, 5, 7.1, 7.2
See application file for complete search history.

(56) References Cited

U.S. PATENT DOCUMENTS

| | | | |
|---|---|---|---|
| 1,566,570 | A | 12/1925 | App |
| 3,521,565 | A | 7/1970 | Plasser et al. |
| 3,593,666 | A | 7/1971 | Savage |
| 3,593,918 | A | 7/1971 | Borst |
| 3,604,361 | A | 9/1971 | Harbert et al. |
| 3,613,600 | A | 10/1971 | Pettit |
| 3,633,513 | A | 1/1972 | Plasser et al. |
| 3,654,868 | A | 4/1972 | Plasser et al. |
| 3,661,310 | A | 5/1972 | Gross |
| 3,680,486 | A | 8/1972 | Plasser et al. |

(Continued)

FOREIGN PATENT DOCUMENTS

| | | | |
|---|---|---|---|
| EP | 0168101 | A2 | 1/1986 |

(Continued)

OTHER PUBLICATIONS

Website print-out: *Cartopper Material Handler*, Herzog Contracting Corp., Jan. 2004—5 pgs.

(Continued)

*Primary Examiner*—S. Joseph Morano
*Assistant Examiner*—Robert J. McCarry, Jr.
(74) *Attorney, Agent, or Firm*—Patterson, Thuente, Skaar & Christensen, P.A.

(57) ABSTRACT

A long rail pick-up and delivery system providing increased efficiency and safety. The long rail pick-up and delivery system can include a power car, a rail train, a loading car, an unloading car, a transition car and two independent gantries. The dual gantry design allows for simultaneous and independent loading and unloading of long rail on both sides of the long rail pick-up and delivery system. The gantries are operably mounted on a elevated track whereby the gantries are capable to traversing the length of the rail train. The gantries can include booms having multiple degrees of freedom allowing a gripping head to grasp and pull long rail regardless of the resting attitude of the long rail. The long rail pick-up and delivery system can also include additional power cars, an integrated work station and additional gantries.

27 Claims, 33 Drawing Sheets

U.S. PATENT DOCUMENTS

| | | | |
|---|---|---|---|
| 3,682,383 | A | 8/1972 | Borst |
| 3,685,456 | A | 8/1972 | Plasser et al. |
| 3,699,894 | A | 10/1972 | Plasser et al. |
| 3,726,232 | A | 4/1973 | Bryan |
| 3,731,635 | A | 5/1973 | Hambrick |
| 3,732,021 | A | 5/1973 | Rizza et al. |
| 3,738,280 | A | 6/1973 | Barthalon |
| 3,745,601 | A | 7/1973 | Appelt |
| 3,754,505 | A | 8/1973 | Dyballa |
| 3,762,333 | A | 10/1973 | Theurer et al. |
| 3,772,830 | A | 11/1973 | Hambrick |
| 3,796,160 | A | 3/1974 | Waters et al. |
| 3,797,402 | A | 3/1974 | Karch |
| 3,801,751 | A | 4/1974 | Ross |
| 3,802,348 | A | 4/1974 | Bryan |
| 3,807,310 | A | 4/1974 | Plasser et al. |
| 3,847,085 | A | 11/1974 | Rypinski |
| 3,847,088 | A | 11/1974 | Karch |
| 3,890,904 | A | 6/1975 | Edwards |
| 3,896,734 | A | 7/1975 | Plasser et al. |
| 3,955,895 | A | 5/1976 | Raimbault |
| 3,968,752 | A | 7/1976 | Theurer |
| 3,972,292 | A | 8/1976 | Theurer |
| 3,974,596 | A | 8/1976 | Huboud-Peron |
| 3,999,276 | A | 12/1976 | Brown et al. |
| 4,000,699 | A | 1/1977 | Scheuchzer et al. |
| 4,004,524 | A | 1/1977 | Scheuchzer |
| 4,046,077 | A | 9/1977 | Theurer et al. |
| 4,094,249 | A | 6/1978 | Theurer et al. |
| 4,102,272 | A | 7/1978 | Lehl et al. |
| 4,160,418 | A | 7/1979 | Theurer |
| 4,168,836 | A | 9/1979 | Weinberg et al. |
| 4,171,774 | A | 10/1979 | Deslauriers |
| 4,184,431 | A | 1/1980 | Goel |
| 4,195,741 | A | 4/1980 | Newman |
| 4,204,476 | A | 5/1980 | Cicin-Sain |
| 4,207,820 | A | 6/1980 | Cicin-Sain |
| 4,211,170 | A | 7/1980 | Theurer |
| 4,214,665 | A | 7/1980 | Newman |
| 4,222,332 | A | 9/1980 | Newman |
| 4,232,610 | A | 11/1980 | Theurer |
| 4,236,452 | A | 12/1980 | Theurer et al. |
| 4,236,453 | A | 12/1980 | Collen |
| 4,240,354 | A | 12/1980 | Newman |
| 4,272,664 | A | 6/1981 | Theurer |
| 4,274,334 | A | 6/1981 | Lund |
| 4,276,985 | A | 7/1981 | Newman |
| 4,284,009 | A | 8/1981 | Theurer |
| 4,301,738 | A | 11/1981 | Theurer |
| 4,307,667 | A | 12/1981 | Scheuchzer |
| 4,323,013 | A | 4/1982 | Theurer |
| 4,325,306 | A | 4/1982 | Valditerra |
| 4,356,771 | A | 11/1982 | Theurer |
| 4,393,784 | A | 7/1983 | Theurer |
| 4,403,734 | A | 9/1983 | Gorman |
| 4,428,296 | A | 1/1984 | Scheuchzer |
| 4,502,389 | A | 3/1985 | Theurer et al. |
| 4,516,503 | A | 5/1985 | Boccaletti |
| 4,522,323 | A | 6/1985 | LaBounty |
| 4,542,697 | A | 9/1985 | Cicin-Sain |
| 4,569,454 | A | 2/1986 | Sterner |
| 4,588,347 | A | 5/1986 | Murta |
| 4,636,130 | A | 1/1987 | Lenertz et al. |
| 4,643,100 | A | 2/1987 | Valditerra |
| 4,646,875 | A | 3/1987 | Sholl |
| 4,668,031 | A | 5/1987 | Dumontet et al. |
| 4,688,689 | A | 8/1987 | Barsuhn |
| 4,715,534 | A | 12/1987 | Fee |
| 4,721,429 | A | 1/1988 | Fujita et al. |
| 4,724,653 | A | 2/1988 | Buhler |
| 4,733,598 | A | 3/1988 | Innes et al. |
| 4,820,168 | A | 4/1989 | Scarpatetti et al. |
| 4,829,907 | A | 5/1989 | Theurer et al. |
| 4,832,261 | A | 5/1989 | Fee |
| 4,833,851 | A | 5/1989 | Ohmatsu |
| 4,854,243 | A | 8/1989 | Theurer |
| 4,862,809 | A | 9/1989 | Guadagno |
| 4,867,068 | A | 9/1989 | Valditerra |
| 4,886,414 | A | 12/1989 | Fujita et al. |
| 4,911,599 | A | 3/1990 | Theurer et al. |
| 4,924,042 | A | 5/1990 | Valditerra |
| 4,929,816 | A | 5/1990 | Theurer et al. |
| 4,947,756 | A | 8/1990 | Kusel et al. |
| 4,951,573 | A | 8/1990 | Madison |
| 4,979,247 | A | 12/1990 | Buhler |
| 4,986,189 | A | 1/1991 | Theurer et al. |
| 5,018,666 | A | 5/1991 | Cryderman et al. |
| 5,073,077 | A | 12/1991 | Altman |
| 5,088,014 | A | 2/1992 | Boughey |
| 5,100,278 | A | 3/1992 | Westlake |
| 5,172,635 | A | 12/1992 | Theurer |
| 5,175,405 | A | 12/1992 | Karimine et al. |
| 5,176,485 | A | 1/1993 | Ruder et al. |
| 5,181,472 | A | 1/1993 | Scheuchzer |
| 5,182,995 | A | 2/1993 | Theurer |
| 5,191,839 | A | 3/1993 | Young et al. |
| 5,195,436 | A | 3/1993 | Valditerra |
| 5,222,435 | A | 6/1993 | Theurer et al. |
| 5,224,575 | A | 7/1993 | Plichta |
| 5,249,654 | A | 10/1993 | Bruning |
| 5,251,732 | A | 10/1993 | Bruning |
| 5,265,741 | A | 11/1993 | Shimizu et al. |
| 5,267,634 | A | 12/1993 | Bruning |
| 5,270,514 | A | 12/1993 | Wechselberger et al. |
| 5,289,780 | A | 3/1994 | Bounds |
| 5,331,898 | A | 7/1994 | Villedieu et al. |
| 5,357,867 | A | 10/1994 | Theurer et al. |
| 5,385,102 | A | 1/1995 | Villedieu et al. |
| 5,454,042 | A | 9/1995 | Drever |
| 5,469,791 | A | 11/1995 | Theurer et al. |
| 5,501,346 | A | 3/1996 | Wimmer |
| 5,511,484 | A | 4/1996 | Theurer et al. |
| 5,520,497 | A | 5/1996 | Hertelindi et al. |
| 5,528,991 | A | 6/1996 | Huber |
| 5,552,899 | A | 9/1996 | Park et al. |
| 5,573,080 | A | 11/1996 | Theurer |
| 5,590,601 | A | 1/1997 | Theurer |
| 5,590,833 | A | 1/1997 | Benenowski et al. |
| 5,605,281 | A | 2/1997 | Benenowski et al. |
| 5,609,106 | A | 3/1997 | Aubermann |
| 5,615,615 | A | 4/1997 | Theurer et al. |
| 5,630,365 | A | 5/1997 | Hertelindi |
| 5,660,112 | A | 8/1997 | Theurer |
| 5,664,498 | A | 9/1997 | Theurer et al. |
| 5,709,001 | A | 1/1998 | Felber |
| 5,731,987 | A | 3/1998 | Strong et al. |
| 5,762,464 | A * | 6/1998 | Hertelindi ..... 414/486 |
| 5,804,793 | A | 9/1998 | Faroldi |
| 5,865,327 | A | 2/1999 | Johnston |
| 5,904,098 | A | 5/1999 | Theurer et al. |
| 5,909,710 | A | 6/1999 | Cummins |
| 5,927,600 | A | 7/1999 | Collin et al. |
| 5,934,198 | A | 8/1999 | Fraser |
| 5,946,896 | A | 9/1999 | Daniels |
| 5,961,271 | A | 10/1999 | Theurer et al. |
| 6,068,196 | A | 5/2000 | Benenowski et al. |
| 6,089,161 | A | 7/2000 | Saban |
| 6,089,162 | A | 7/2000 | Madison |
| 6,098,824 | A | 8/2000 | Krebs et al. |
| 6,158,352 | A | 12/2000 | Theurer et al. |
| 6,163,003 | A | 12/2000 | Basttisti |
| 6,167,812 | B1 | 1/2001 | Pugin et al. |
| 6,199,486 | B1 | 3/2001 | Landrum et al. |
| 6,203,233 | B1 | 3/2001 | Stanley |

| | | | |
|---|---|---|---|
| 6,220,169 | B1 | 4/2001 | Rosenquist et al. |
| 6,272,999 | B1 | 8/2001 | Pugin et al. |
| 6,330,951 | B1 | 12/2001 | Johnston |
| 6,375,402 | B1 | 4/2002 | Hertelendi et al. |
| 6,415,208 | B1 | 7/2002 | Podja |
| 6,415,720 | B2 | 7/2002 | Theurer et al. |
| 6,422,150 | B2 | 7/2002 | Theurer et al. |
| 6,450,101 | B2 | 9/2002 | Theurer et al. |
| 6,453,825 | B1 | 9/2002 | Sprave et al. |
| 6,474,241 | B2 | 11/2002 | Theurer et al. |
| 6,477,960 | B2 | 11/2002 | Theurer et al. |
| 6,494,146 | B1 | 12/2002 | Landrum et al. |
| 6,507,163 | B1 | 1/2003 | Allen |
| 6,516,962 | B1 | 2/2003 | Irsch et al. |
| 6,550,624 | B1 | 4/2003 | Irsch et al. |
| 6,564,516 | B1 | 5/2003 | Svensson |
| 6,571,717 | B2 | 6/2003 | Svensson |
| 6,616,061 | B1 | 9/2003 | Penny |
| 6,637,340 | B1 | 10/2003 | Wilson |
| 6,640,725 | B2 | 11/2003 | Theurer et al. |
| 6,675,719 | B1 | 1/2004 | Feider et al. |
| 6,981,452 | B2 | 1/2006 | Herzog et al. |
| 2001/0045405 | A1 | 11/2001 | Higgins |
| 2001/0050023 | A1 | 12/2001 | Theurer et al. |
| 2001/0050024 | A1 | 12/2001 | Theurer et al. |
| 2002/0003119 | A1 | 1/2002 | Rode et al. |
| 2002/0005139 | A1 | 1/2002 | Theurer et al. |
| 2002/0006326 | A1 | 1/2002 | Trinler et al. |
| 2002/0054785 | A1 | 5/2002 | Betts |
| 2002/0056694 | A1 | 5/2002 | Rode et al. |
| 2002/0073875 | A1 | 6/2002 | Liew |
| 2002/0073876 | A1 | 6/2002 | Svensson |
| 2002/0088369 | A1 | 7/2002 | Howarth |
| 2002/0100740 | A1 | 8/2002 | Amoss |
| 2002/0106098 | A1 | 8/2002 | Wetzel et al. |
| 2003/0010248 | A1 | 1/2003 | Theurer et al. |
| 2003/0026446 | A1 | 2/2003 | Davis |
| 2003/0037694 | A1 | 2/2003 | Theurer et al. |
| 2003/0094290 | A1 | 5/2003 | Theurer et al. |
| 2003/0141283 | A1 | 7/2003 | Theurer et al. |
| 2003/0172836 | A1 | 9/2003 | Villar et al. |
| 2003/0205162 | A1 | 11/2003 | Herzog et al. |
| 2005/0172849 | A1 | 8/2005 | Herzog et al. |

FOREIGN PATENT DOCUMENTS

| | | | |
|---|---|---|---|
| EP | 0168101 | A3 | 1/1986 |
| EP | 0168101 | B1 | 1/1986 |
| EP | 0168103 | A2 | 1/1986 |
| EP | 0168103 | A3 | 1/1986 |
| EP | 0168103 | B1 | 1/1986 |
| EP | 0294700 | A2 | 12/1988 |
| EP | 0294700 | A3 | 12/1988 |
| EP | 0294700 | B1 | 12/1988 |
| EP | 0431092 | A1 | 6/1991 |
| EP | 0431092 | B1 | 6/1991 |
| EP | 0505240 | A1 | 9/1992 |
| EP | 0505240 | B1 | 9/1992 |
| EP | 0593361 | A1 | 4/1994 |
| EP | 0593361 | B1 | 4/1994 |
| EP | 09926828 | | 4/2000 |
| WO | WO 85/00544 | | 2/1985 |
| WO | WO 89/05254 | | 6/1989 |
| WO | WO 90/14470 | | 11/1990 |
| WO | WO 95/17343 | | 6/1995 |
| WO | WO 97/13717 | | 4/1997 |
| WO | WO 97/31857 | | 9/1997 |
| WO | WO 99/01371 | | 1/1999 |
| WO | WO 00/55673 | | 9/2000 |
| WO | WO 01/14239 | | 3/2001 |
| WO | WO 01/72624 | | 10/2001 |
| WO | WO 02/072275 | | 9/2002 |
| WO | WO 03/033392 | | 4/2003 |
| WO | WO 03/078224 | | 9/2003 |
| WO | WO 2005/095715 | A1 | 10/2005 |

OTHER PUBLICATIONS

Website print-out: *2-— Rail Crane Mod. TCR-V*, www.vaiacar.it, Dec. 2003, 2 pgs.

Website print-out: *1-Rails Loading Train*, www.vaiacar.it, Dec. 2003, 1 pg.

* cited by examiner

LONG RAIL PICK-UP AND DELIVERY SYSTEM

PRIORITY CLAIM

The present application claims priority to U.S. Provisional Application No. 60/603,200 filed Aug. 20, 2004 and entitled, "LONG RAIL PICK-UP AND DELIVERY SYSTEM," which is herein incorporated by reference in its entirety.

BACKGROUND OF THE INVENTION

A fundamental aspect of operating a safe and efficient rail system involves routine maintenance of the rail line itself. This maintenance can involve upkeep associated with the support structure for the rail line, such as replacing rail ties or ballast upkeep below the rail line. Alternatively, the maintenance can involve maintaining the rails themselves. The rails suffer wear and tear associated with use as well as exposure to harsh environmental conditions, such as heat, rain, snow and ice. Rails having a minimal amount of wear can usually be reground without adversely effecting the functional and safety characteristics of the rail. However, as the rails wear beyond a point in which they can be safely reground or the rails suffer irreparable damage, the worn or damaged rails must be replaced by new rails.

In general, the process of replacing worn or damaged rails involves removing the used rails from the railroad ties and placing the rails such that they lie adjacent the railway bed. Once the old rails have been removed, new rails can be placed over and attached to the railroad ties and the ends of the new rails are joined to form an operable rail line. The old rails can be picked up and transported to a mill for repair or recycling.

In order to reduce the time for removal of old track and installation of new track, the rails are fabricated in lengths of up to a quarter mile in length. By manufacturing rails of this length, the number of joining operations which must be performed at rail ends is significantly reduced. As the joining process can be one of the most time intensive portions of laying new track, reducing the amount of joining connections leads to a significant cost reduction in the form of reduced labor expenditures. While removing and installing rail of these lengths can result in significant cost savings, the use of such long rail requires the use of specialized equipment capable of handling the increased length and corresponding increased weight of the rails.

A variety of rail pick-up systems have been developed to work with long rails. For instance, U.S. Pat. No. 5,520,497 is directed to rail supports for use with rail loading systems, while U.S. Pat. No. 5,630,365 is directed to locking rail supports for use with rail loading trains. In addition, some of the rail pick-up and transport systems known to those skilled in the art include booms or arms to assist the crews in picking up the worn rails. One example of such a boom is described in U.S. Application Publication No. US20030205162A1, which discloses a railway maintenance machine that includes a service vehicle having an articulating boom. Despite the presence of these long rail systems, there continues to be a need for a rail pickup system that further increases efficiency while improving upon operator safety.

SUMMARY OF THE INVENTION

The long rail pick-up and delivery system of the present invention simultaneously addresses the needs for increased efficiency and safety. The long rail pick-up and delivery system of the current invention can comprise a power car, a rail train, a loading car, a work car, an unloading car, a transition car and a pair of independently operable overhead gantries. In some embodiments, the long rail pick-up and delivery system can further comprise additional gantries, at least one additional power car and/or an integrated rail welding and grinding station.

In one aspect of the long rail pick-up and delivery system, the independent gantries provide for completely independent and simultaneous loading and unloading of rails on both sides of the long rail pick-up and delivery system. Each gantry includes its own boom for grasping and manipulating the rail such that it can be either loaded onto or unloaded from the long rail pick-up and delivery system. The gantries are operably mounted on an elevated rail such that each gantry is capable of traversing the length of the rail train. In addition, each gantry includes an enclosed operator station providing the gantry operators with a clear, overhead view of the work area. In some representative embodiments, the gantry can further comprise a rear cab portion that is vertically positionable with respect to the rail train such that an operator can be provided access to various rails clamps and brackets along the rail train as the length of rail is loaded or unloaded from the rail train.

In another aspect, the long rail pick-up and delivery system includes independently operated gantries that can include a boom having seven degrees of operational freedom. The boom can be telescopic such that the boom reach is extendable up to a distance of twenty feet from the center of the track and four feet below the tip of the rail. The boom can be mounted to a rotatable turret allowing for up to 360° of operation about the gantry. The boom can be vertically adjustable to provide reaching capabilities regardless of the topography alongside the railbed. The boom can include an articulating gripping head in which the gripping head can be both rotatably and angularly adjustable with respect to the boom such that the gripping head can be adjustably configured to conform with the resting attitude of the rail.

In another aspect, the long rail pick-up and delivery system includes independently operated gantries with sufficient tractive force to allow the gantries to pull a section of long rail onto the rail train without requiring the assistance of the power car. By providing gantries with sufficient tractive force to load the long rails, loading of long rail can be accomplished simultaneously on both sides of the long rail pick-up and delivery system such that the loading process can be accomplished in significantly less time.

In another aspect, the long rail pick-up and delivery system can include independently operated gantries operably mounted on elevated gantry rails extending the length of the rail train. The elevated gantry rails can consist of linked and aligned beams with transition members between cars. The beams can be box beams or I-beams. By providing a gripping region on opposed sides of a beam such as, for example, top and bottom sides or left and right sides, the elevated gantry rails can provide for an increase in the tractive effort while simultaneously decreasing the potential for derailment of the gantry.

In another aspect, the long rail pick-up and delivery system can include an integral workstation for rail cutting, drilling, and joining/welding. An integral workstation eliminates the requirement that operators be exposed to the dangers associated with manipulating and working upon rails located in a ditch alongside the rail line. Instead, the integral workstation can incorporate the manipulation and working steps on the long rail pick-up and delivery system whereby the dangers associated with working in the ditch alongside the rail line are eliminated. In addition, the ancillary work equipment required to work in the ditch is no longer necessary.

In another aspect, the long rail pick-up and delivery system can include rail trains having rail racks to facilitate loading and transport of the long rails. The rail rack having a three post rack design providing for greater holding strength, stability and maintainability than current two post rack designs. The rail rack can include rollers, tie downs and/or hydraulically controlled rail guides.

BRIEF DESCRIPTION OF THE DRAWINGS

The invention may be more completely understood in consideration of the following detailed description of various embodiments of the invention in connection with the accompanying drawings, in which.

Figure 1:
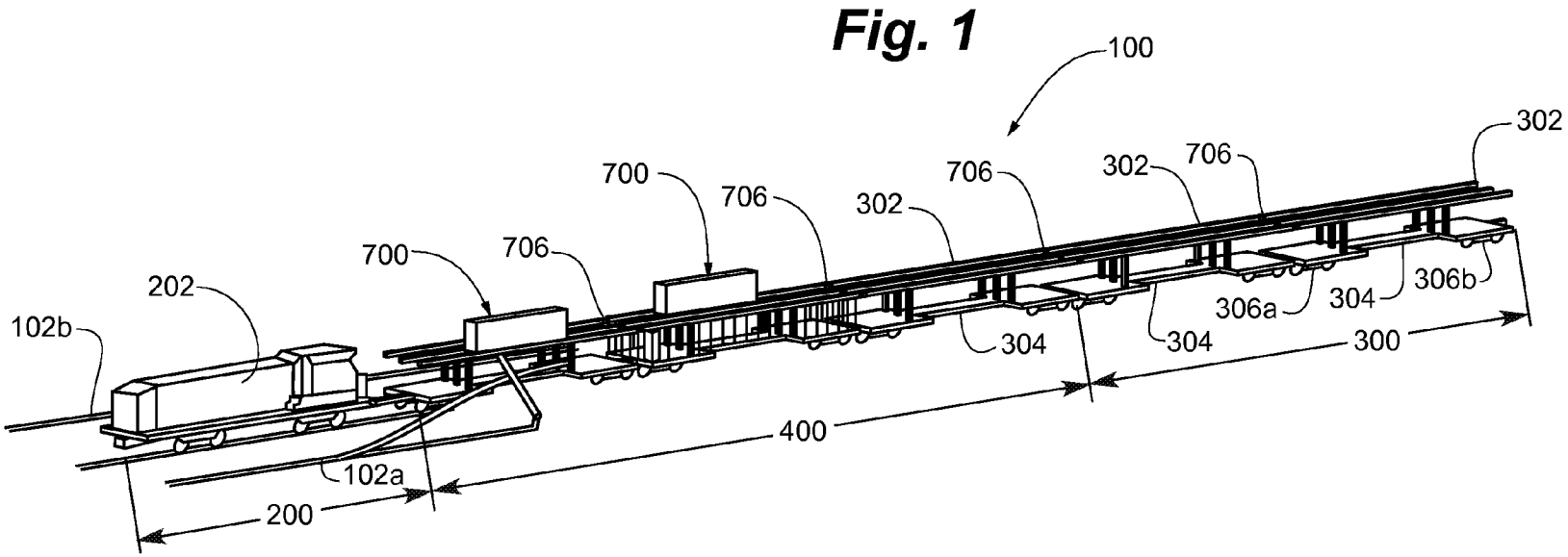
FIG. 1 is a perspective view of an embodiment of a long rail pick-up and delivery system.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION OF THE PREFERRED EMBODIMENTS

An embodiment of a long rail pick-up and delivery system 100 is illustrated in FIG. 1. Long rail pick-up and delivery system 100 generally consists of an integrated power plant 200, a rail transport train 300, a work unit 400, and a gantry system 700. Long rail pick-up and delivery system 100 can be configured for use with a variety of rail sizes, for example 112-pound to 141-pound rail in lengths up to one-quarter mile.

Figure 2:
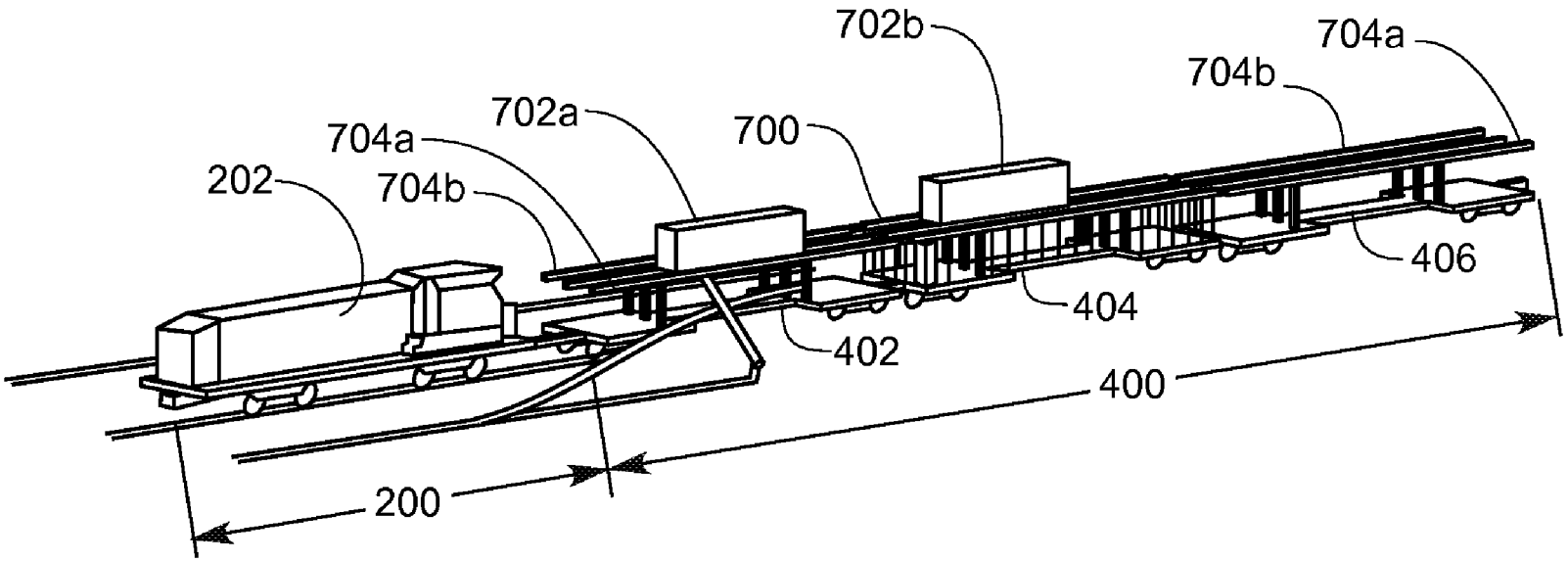
FIG. 2 is a perspective view of an embodiment of a power car and work unit for use with the long rail pick-up and delivery system of FIG. 1.

Integrated power plant 200 generally comprises a diesel locomotive 202, as shown in FIGS. 1 and 2. An example of a suitable diesel locomotive 202 can be a turbocharged, modified 6-axle locomotive design with a horsepower rating of 3,000 horsepower. In alternative embodiments, integrated power plant 200 can consist of a plurality of diesel locomotives, for example a first locomotive rated for 3,000 horsepower and a second locomotive rated for 3,000 horsepower for a combined power rating of 6,000 horsepower. Based on rail grade and operating conditions, it will be understood that a variety of combinations of locomotives could be utilized to provide suitable tractive effort to accomplish rail loading and unloading as will be described below. In a preferred embodiment, integrated power plant 200 has sufficient power to allow the long rail pick-up and delivery system 100 to travel at speeds approaching sixty (60) mph.

Figure 3:
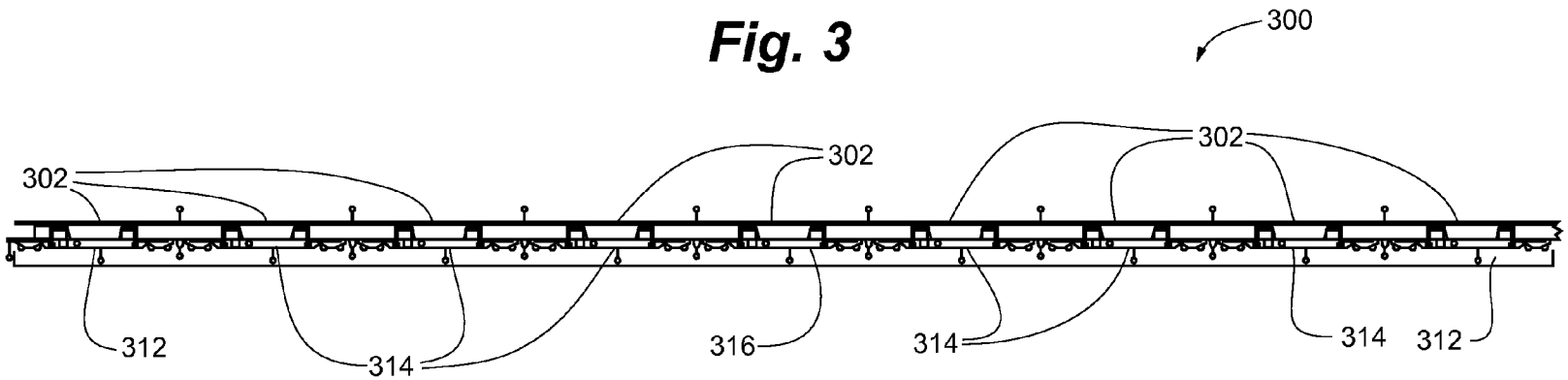
FIG. 3 is a side view of an embodiment of a rail storage train having nine rail cars for use with the power car and work unit of FIG. 2.

Rail transport train 300, as depicted in FIGS. 1 and 3, comprises a plurality of interconnected rail transport cars 302. Each rail transport car 302 comprises a platform frame 304 and a pair of wheel trucks 306*a*, 306*b*. Depending upon location along the rail transport train 300, rail transport car 302 can comprise either a coupler or drawbar receiver 310 at each end of the rail transport car. Each rail transport car 302 is approximately sixty feet long between the coupler, drawbar receiver 310 or combinations thereof. Examples of suitable wheel trucks can include AAR (Association of American Railroads) approved 100-ton trucks having anti-friction journal bearings, Class "C" steel car wheels, spring type suspensions and air brakes.

Rail transport train 300 can be configured to have any suitable length, generally dependent upon the length of rail being loaded and/or unloaded, by varying the number of interconnected rail transport cars 302. Regardless of length, rail transport 300 generally comprises an arrangement of rail transport cars 302 configured as either an end transport car 312, a rail transport car 314 or a rail clamp car 316. Generally, the rail transport train 300 consists of two end transport cars 312, one located at each end of the rail transport train 300, connected with a desired number of center transport cars 314 and a centrally located rail clamp car 316 such that rail transport train 300 has a desired length. In one presently preferred embodiment, rail transport train 300 can comprise an arrangement of nine rail transport cars 302 including two end transport cars 312, six center transport cars 314 and one rail clamp car 316 as illustrated in FIG. 3.

Figure 4:
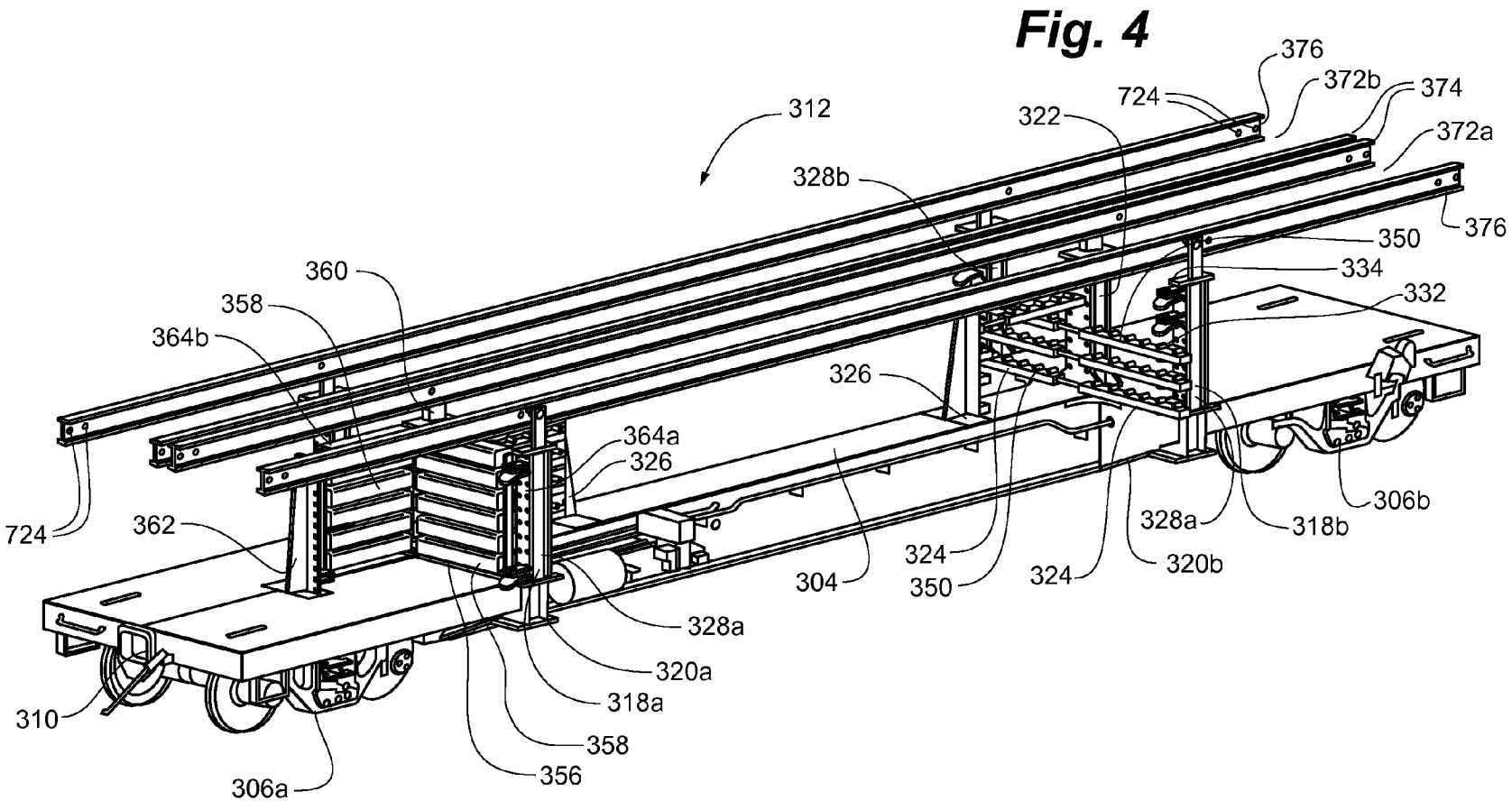
FIG. 4 is a perspective view of an embodiment of a rail car configured as an end transport car.
Figure 5:
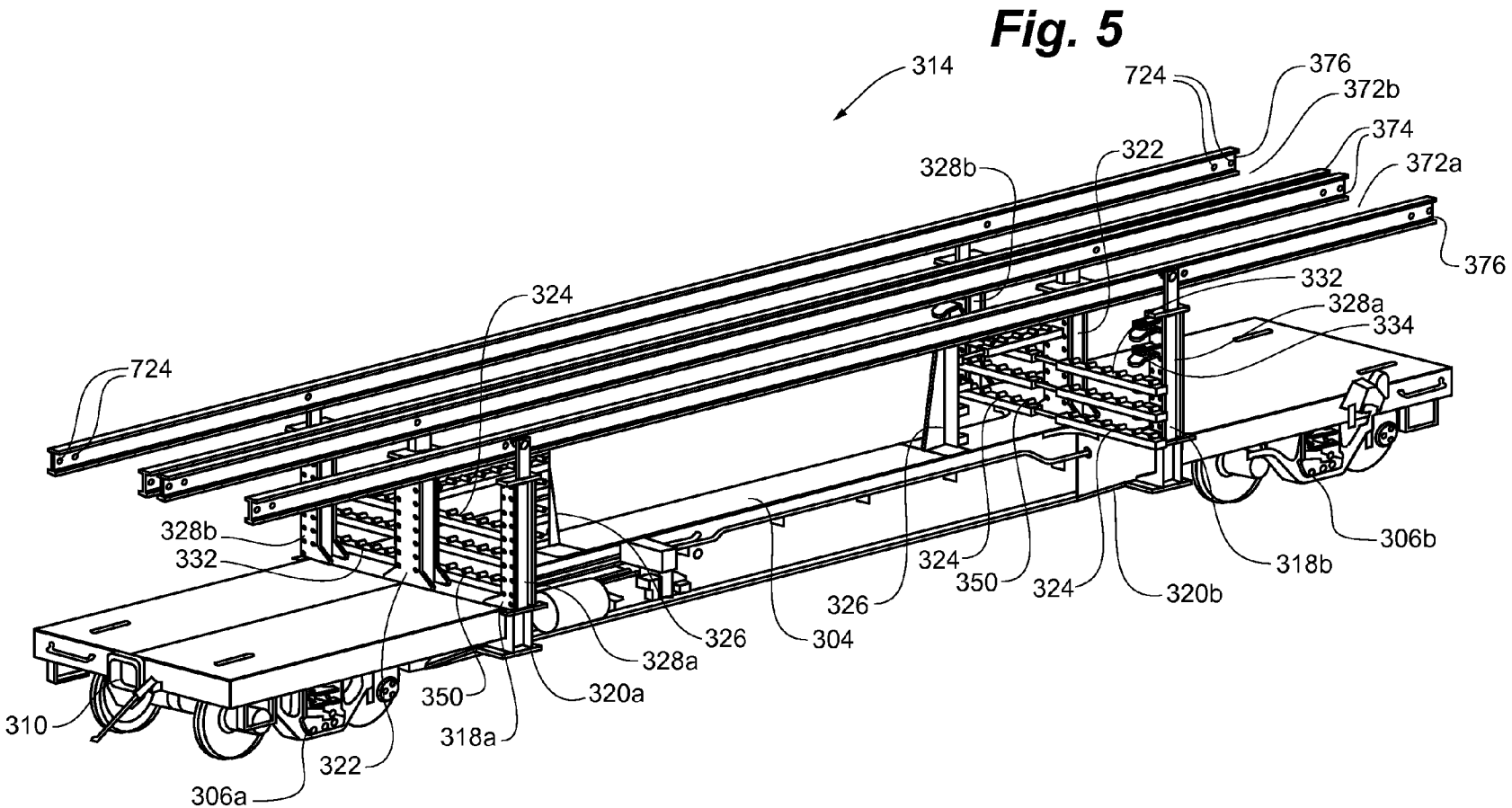
FIG. 5 is a perspective view of an embodiment of a rail car configured as a rail transport car.
Figure 6:
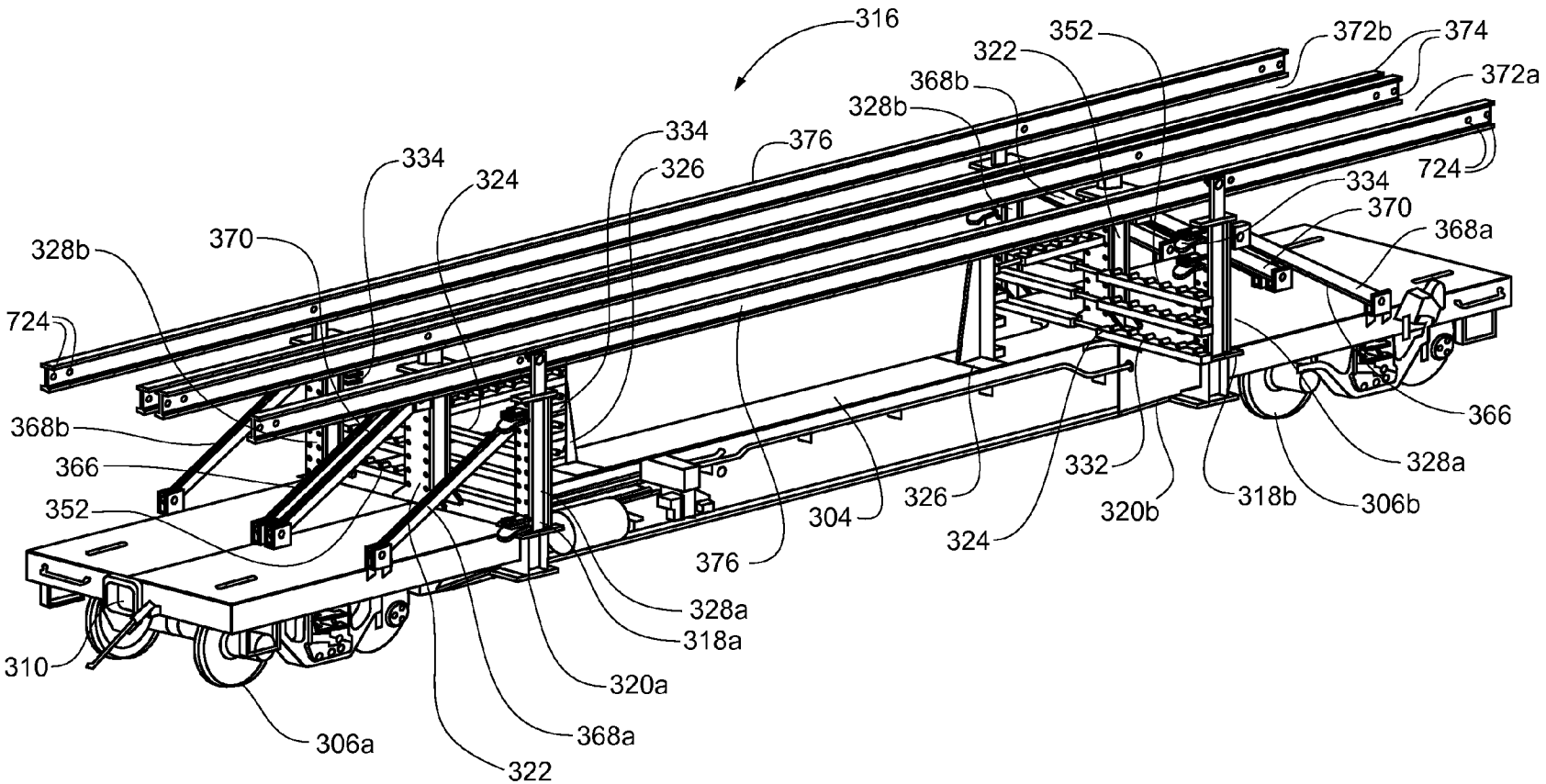
FIG. 6 is a perspective view of an embodiment of a rail car configured as a rail clamp car.

Regardless of configuration, each rail transport car 302 generally comprises a pair of rack support systems 318*a*, 318*b* as illustrated in FIGS. 4, 5 and 6. Rack support systems 318*a*, 318*b* are spaced apart at thirty-foot intervals on each rail car 302. By spacing rack support systems 318*a*, 318*b* at thirty-foot intervals, a thirty-foot spacing can maintained along the length of rail transport train 300, for example, between rack supporting systems on adjacent rail transport cars. Through equivalent spacing of the rack support systems 318*a*, 318*b* along the rail transport train 300, loads can be evenly distributed along the length of rail transport train 300. To accommodate rack support systems 318*a*, 318*b*, the rail platform 304 can include bottom support structures 320*a*, 320*b* positioned below the corresponding rack support system 318*a*, 318*b*.

As illustrated in FIGS. 4, 5, 6 and 7, each rack support system 318*a*, 318*b* comprises a central support column 322, a plurality of rail racks 324, a central receiving column 326 and a pair of exterior receiving columns 328*a*, 328*b*. Central support column 322 includes a series of vertically spaced rotation brackets 330 in which the rail racks 324 are individually, pivotally mounted. When pivotally mounted, each rail rack 324 defines a rail loading row 332. Both the central receiving column 326 and the exterior receiving columns 328*a*, 328*b* include a plurality of locking brackets 334 vertically positioned and spaced apart to correspond to the rotation brackets 330. Locking brackets 334 each include a receiving member 336 and a guiding member 338 spaced apart to accept a rail rack end 340 of the rail rack 324. Guiding member 338 includes an angled receiving portion 342 for assisting with proper positioning of the rack end 340 between the receiving member 336 and guiding member 338. The rail rack 324 can then be fixedly locked within the locking bracket 334 by inserting a locking member 344 through corresponding bores in the receiving member 336, guiding member 338 and rail rack end 340. Locking member 344 can comprise a suitable locking device including a nut and bolt assembly or a locking pin assembly. When rail rack 324 is locked to the central receiving column 326, a rail loading configuration 346 is defined. When rail rack 324 is locked to the exterior receiving columns 328*a*, 328*b*, a rail supporting configuration 348 is defined.

Figure 7:
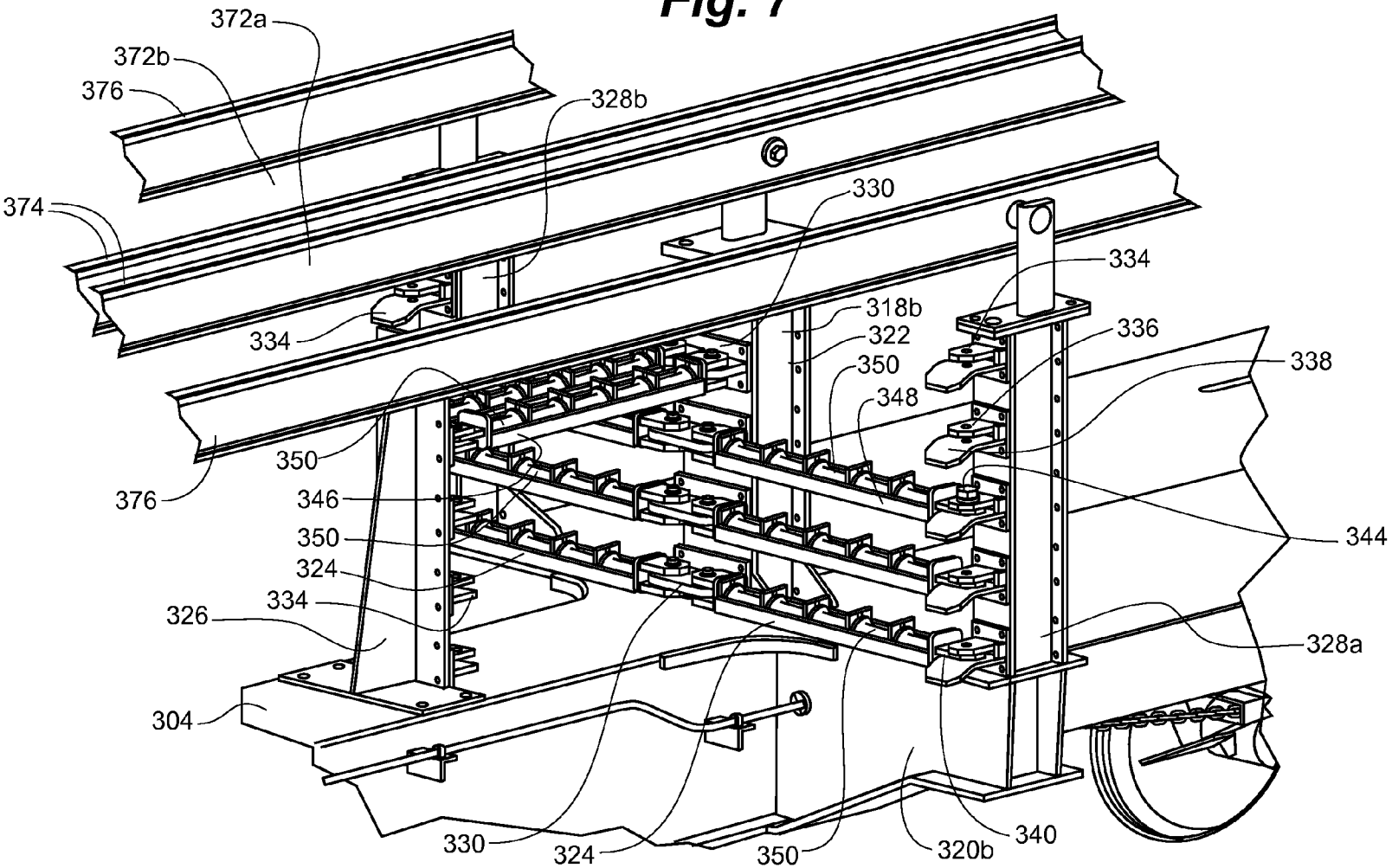
FIG. 7 is an expanded perspective view of an embodiment of a rack support system for use with rail cars of the present invention.
Figure 8:
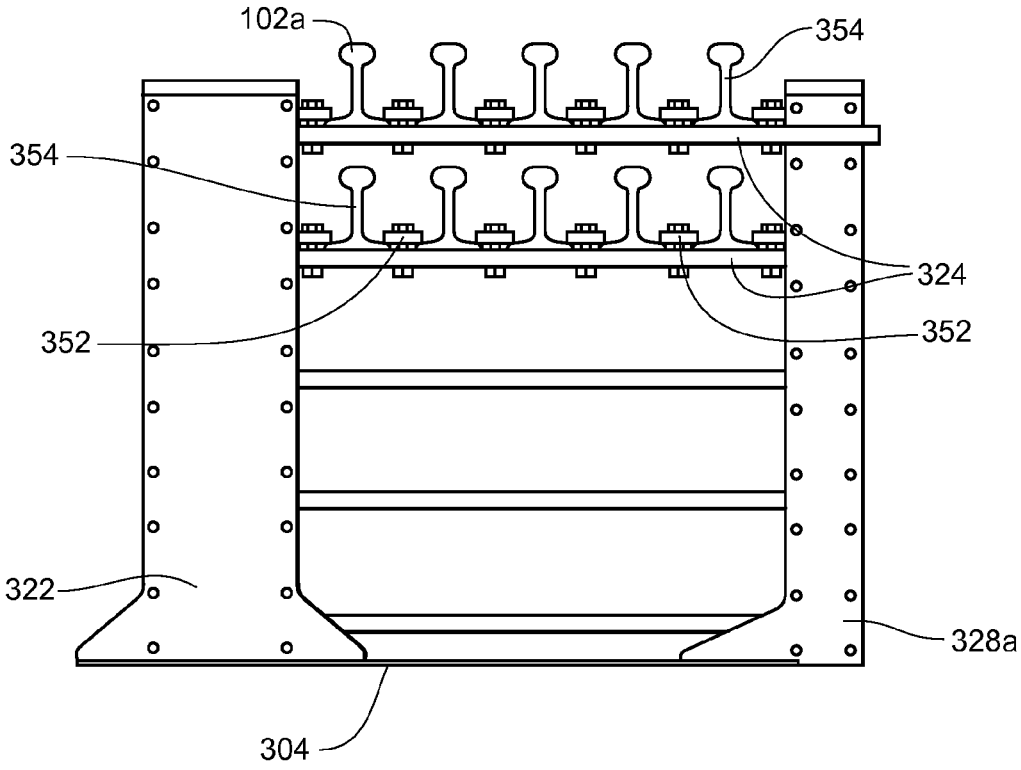
FIG. 8 is an end view of an embodiment of a rack support system for use with the rail clamp car of FIG. 6.

Rack support systems 318*a*, 318*b* are configurable based on the type of rail transport car 302 such as, for example, end transport car 312, rail transport car 314 or rail clamp car 316, the rack support systems 318*a*, 318*b* are mounted upon. For example, each rail rack 324 on an end transport car 312 and a rail transport car 314 can comprise a plurality of roller assemblies 350 as illustrated in FIG. 7 to facilitate placement of the rail down the length of the rail transport train 300. Each roller assembly 350 can comprise a ceramic sleeve type bearing for improved life under the loading conditions associated with long rail. With respect to rail clamp car 316, each rail rack 324 can include a plurality of rail tie downs 352 or clamps as illustrated in FIG. 8 to hold and fix the position of the rail with respect to the rail transport train 300. In an alternative embodiment of the invention, each rack support system 318*a*, 318*b* can comprise a single rail rack 324 having rail tie downs 352 while the remaining rail racks 324 have roller assemblies 350. In this embodiment, the position of the rail racks 324 having rail tie downs 352 are staggered along the series of rail transport cars 302 such that the stress of locking and holding rail with the rail tie downs 352 is spread along the length of the rail transport train 300. In alternative embodiments, the rail transport cars 302 can have alternative configurations of roller assemblies 350 and rail tie downs 352 based upon factors such as rail length, operating environment and safety requirements. Regardless of configuration, roller assemblies 350 and rail tie downs 352 that are correspondingly aligned and spaced, both vertically and horizontally, on successive rail racks 324 are said to define a loading pocket 354, which, defines the storage or loading position of a long rail on the rail transport train 300. For instance, rack support systems 318*a*, 318*b* having ten rail racks 324 wherein each rail rack 324 includes five roller assemblies 350 or, five rail tie downs 352 defines fifty individual loading pockets 354 extending the length of rail transport train 300.

Figure 9:
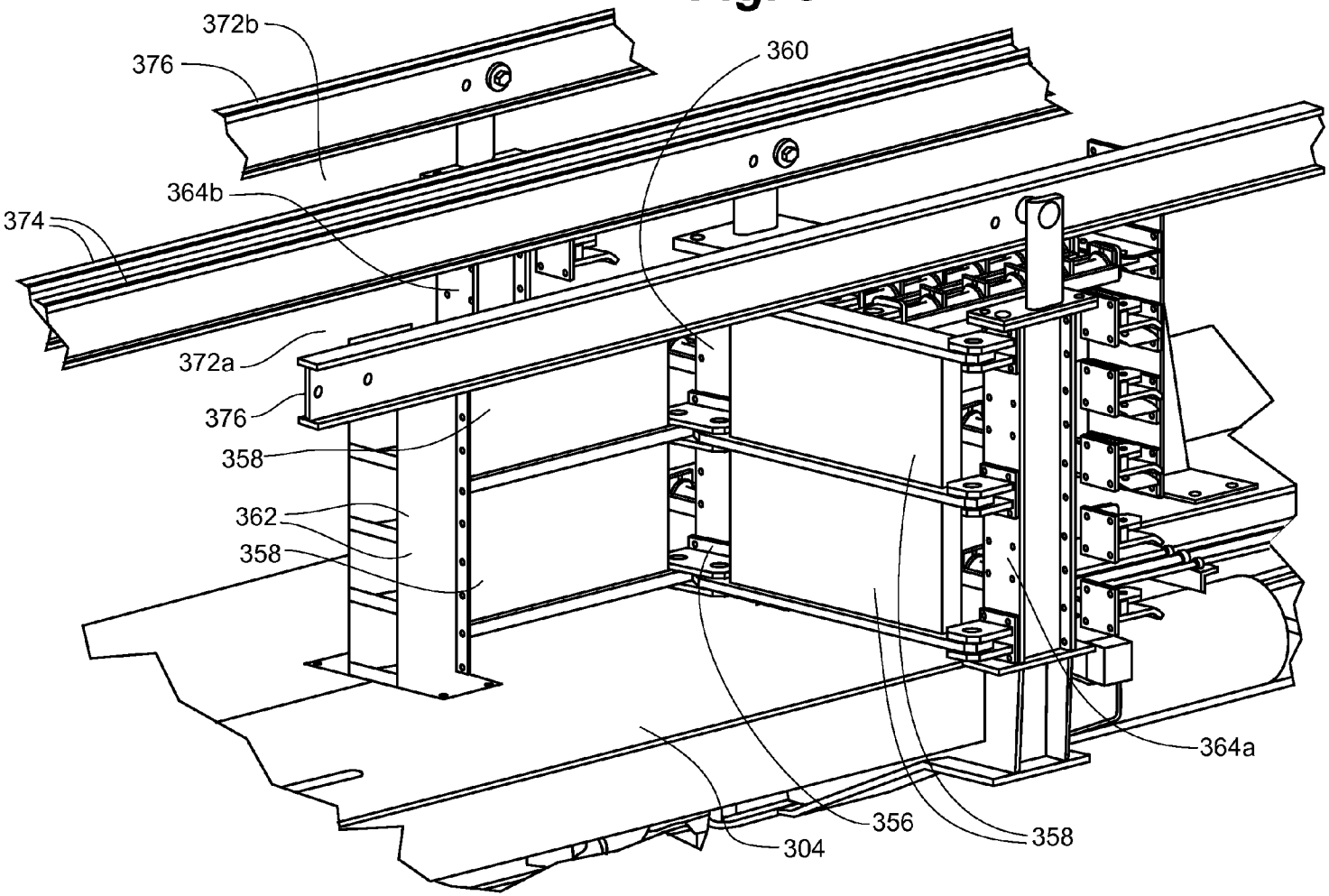
FIG. 9 is an expanded perspective view of a bulkhead assembly for use with the end transport car of FIG. 4.

In addition to utilizing rack support systems 318*a*, 318*b*, the various rail car configurations can comprise additional features corresponding to their intended use. For example, the end transport cars 312 as illustrated in FIGS. 4 and 9 can comprise a bulkhead assembly 356 at the ends of the rail transport train 300. Bulkhead assembly 356 can comprise a plurality of bulkhead doors 358 rotatably mounted to a central bulkhead support 360 such that each bulkhead door 358 is rotatable between a bulkhead loading column 362 and a pair of exterior bulkhead restraining columns 364*a*, 364*b*. In an alternative arrangement, the bulkhead doors 358 can be adapted to mount between the central support column 322 and the exterior receiving columns 328*a*, 328*b* of the rack support systems 318*a*, 318*b*.

As illustrated in FIG. 6, rail clamp car 316 can comprise additional support structure so as to accommodate and distribute linear stresses associated with clamping, retaining and transporting long rail. On rail clamp car 316, each of the rack support systems 318*a*, 318*b* can comprise a rack support structure 366. Rack support structure 366 can include a pair of exterior column supports 368*a*, 368*b* and a central column support 370.

Regardless of length, rail transport 300 generally comprises an arrangement of rail transport cars 302 configured as either an end transport car 312, a rail transport car 314 or a rail clamp car 316. Generally, the rail transport train 300 consists of two end transport cars 312, one located at each end of the rail transport train 300, connected with a desired number of center transport cars 314 and a centrally located rail clamp car 316 such that rail transport train 300 has a desired length. In one presently preferred embodiment, rail transport train 300 can comprise an arrangement of nine rail transport cars 302 including two end transport cars 312, six center transport cars 314 and one rail clamp car 316 as illustrated in FIG. 3.

As illustrated in FIGS. 4, 5 and 6, each rail transport car 302 regardless of car configuration such as, for example, end transport car 312, rail transport car 314 or rail clamp car 316, comprises a pair of rail car gantry lanes 372*a*, 372*b* supported by the central support column 322 and the exterior receiving columns 328*a*, 328*b*. Rail car gantry lanes 372*a*, 372*b* each comprise a central beam 374 and an exterior beam 376. In some embodiments, central beam 374 can be fabricated such that the rail car gantry lanes 372*a*, 372*b* share a common central beam 374.

Figure 10:
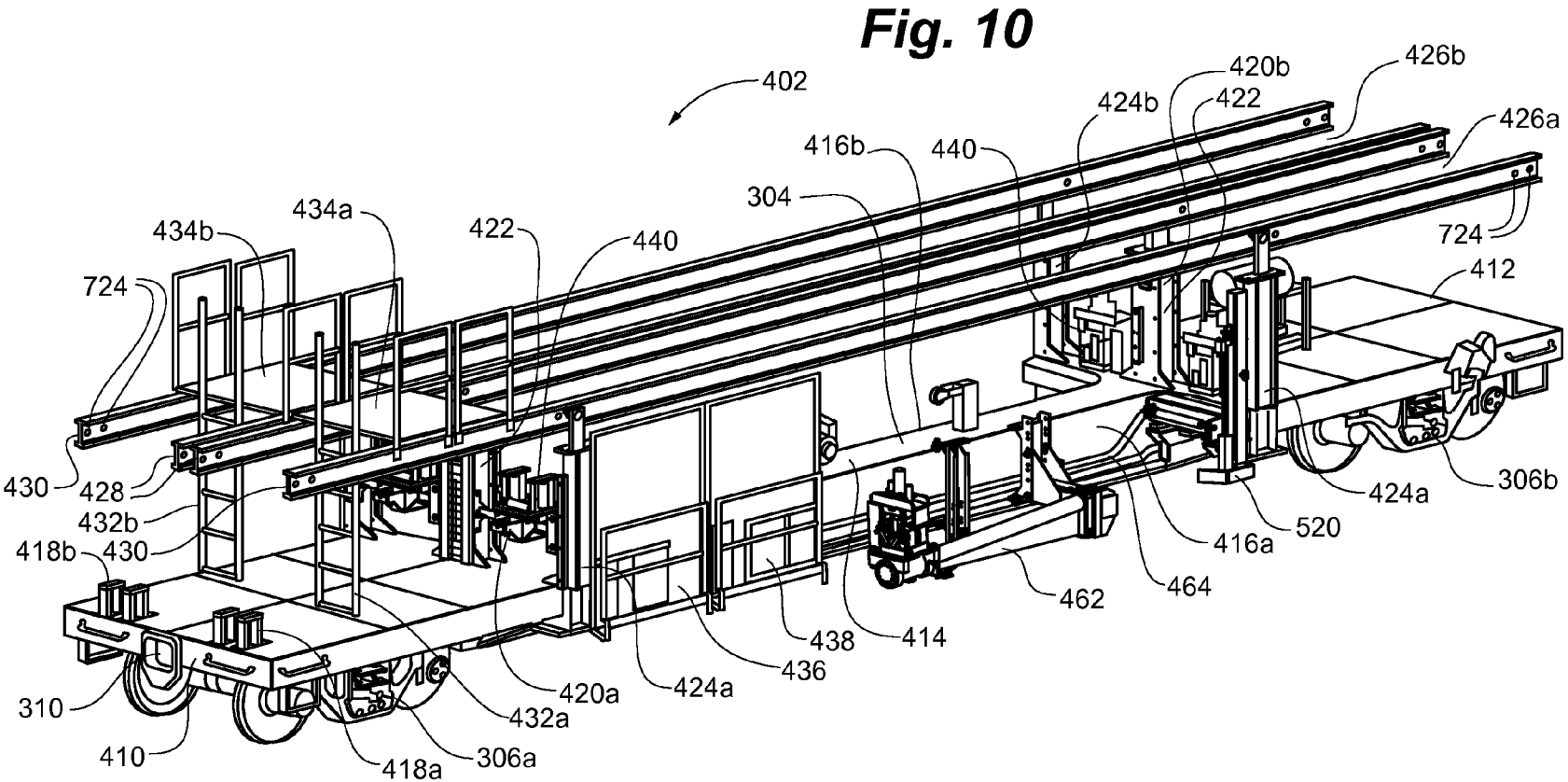
FIG. 10 is a perspective view of an embodiment of a chute car.
Figure 11:
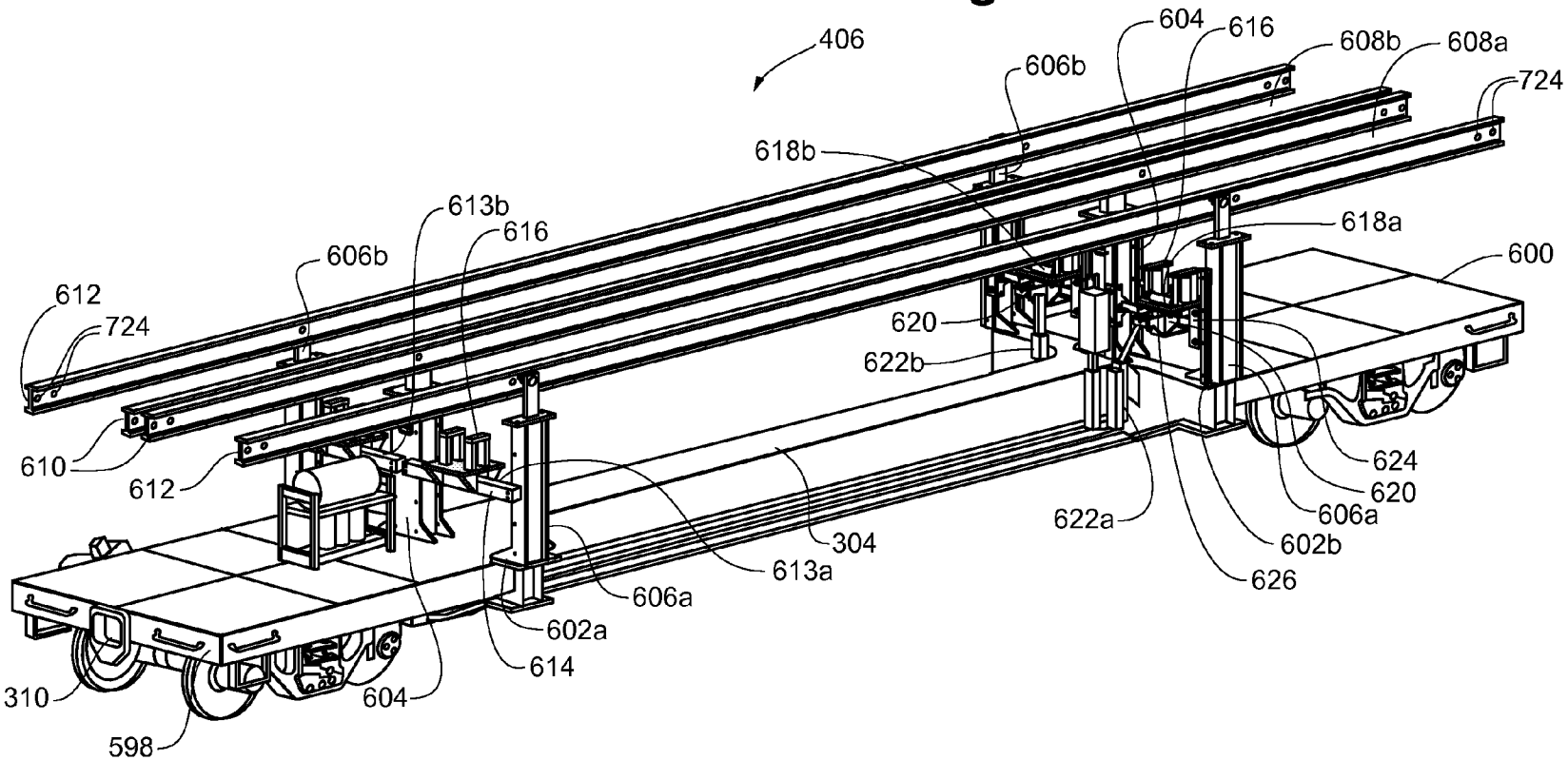
FIG. 11 is a perspective view of an embodiment of a transition car.
Figure 12:
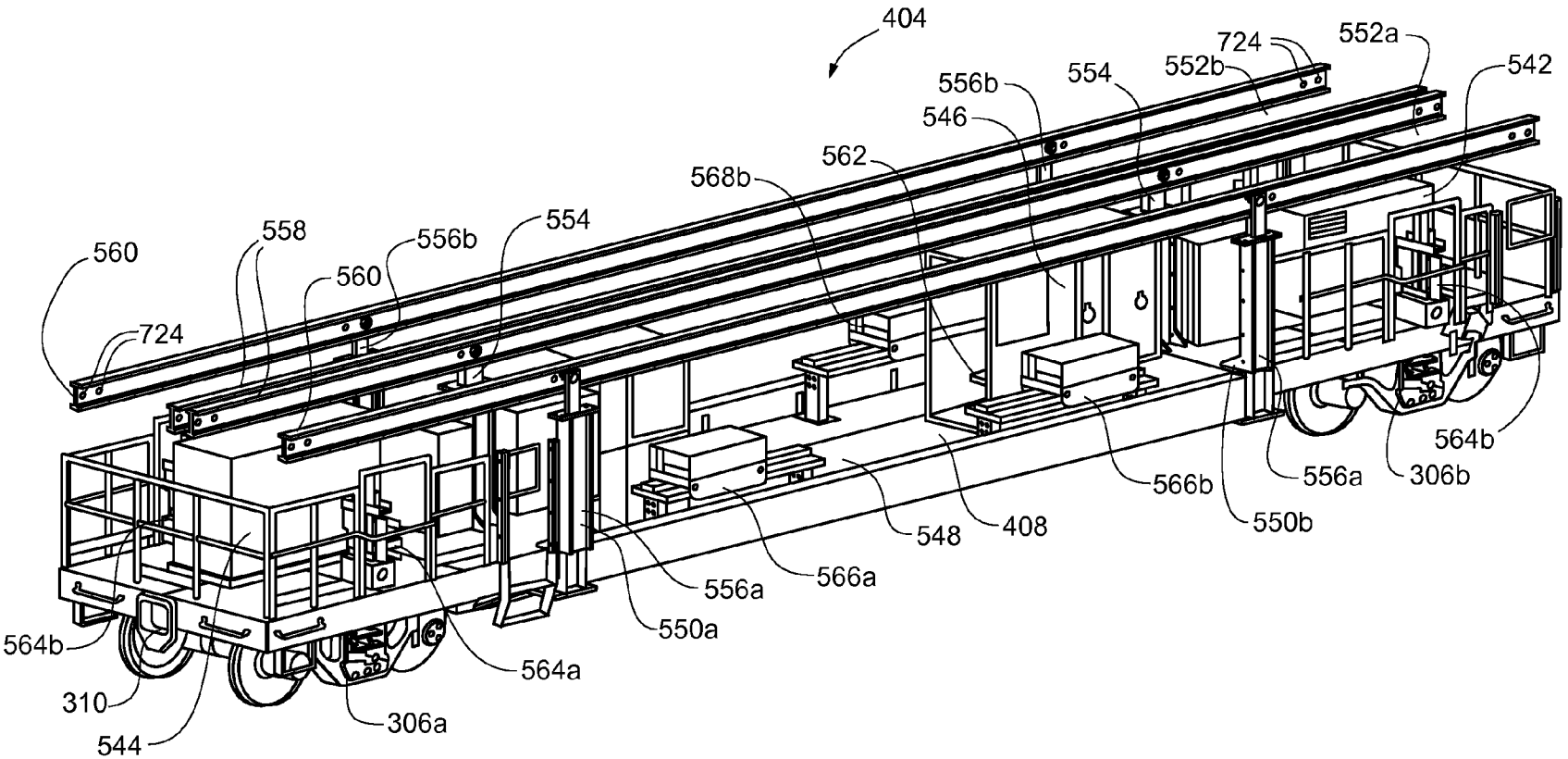
FIG. 12 is a perspective view of an embodiment of a work car.

Work unit 400 can comprise a three-car system composed of a chute car 402, a work car 404 and a transition car 406 as illustrated in FIGS. 1 and 2. As illustrated in FIGS. 10 and 11, chute car 402 and transition car 406 can be fabricated on platform frame 304 and utilize wheel trucks 306*a*, 306 in a similar manner as rail transport car 302. As illustrated in FIG. 12, work car 404 is fabricated to have a work platform 408 and wheel trucks 306*a*, 306*b*. At the ends of chute car 402, work car 404 and transition car 406, the cars can have either coupler 308 or drawbar receiver 310 for operably interconnecting the cars with each other and other components of the long rail pick-up and delivery system 100 such as, for example the integrated power plant 200 and rail transport train 300.

In general, chute car 402 performs the function of positioning long rail in either a rail loading situation from the rail bed to the rail transport train 300 or in an unloading situation from the rail transport train 300 to the rail bed. Referring to FIG. 10, chute car 402 comprises a first chute car end 410 and a second chute car end 412. Chute car 402 includes a center sill 414 with open chute sections 416*a*, 416*b* on each side of the center sill 414. Chute car 402 comprises a pair of rail guides 418*a*, 418*b* at first chute car end 410 so as to accommodate loading and unloading of long rail over first chute are end 410. Open chute sections 416*a*, 416*b* provide an alternative loading and unloading arrangement of long rail between the axles of wheel trucks 306*a*, 306*b*. Chute care 402 comprises a pair of chute car support structures 420*a*, 420*b*. Each chute car support structure 420*a*, 420*b* comprises a center post 422 and a pair of exterior posts 424*a*, 424*b*. Chute care support structures 420*a*, 420*b* support a pair of chute car gantry lanes 426*a*, 426*b*. Chute car gantry lanes 426*a*, 426*b* each comprise a central beam 428 and an exterior beam 430. In some embodiments, central beam 428 can be fabricated such that the chute car gantry lanes 426*a*, 426*b* share a common central beam 428. Chute car 402 can further comprise a pair of gantry ladders 432*a*, 432*b* and a pair of gantry platforms 434*a*, 434*b* for providing operator access to the chute car gantry lanes 426*a*, 426*b*. In addition, chute car 402 can further comprise an access platform 436 pivotally attached to each exterior beam 430. Access platform 436 can be positioned in a stowed configuration 438 as illustrated in FIG. 10 or an access configuration wherein the access platform from side access to the chute car gantry lanes 426*a*, 426*b*.

Figure 13:
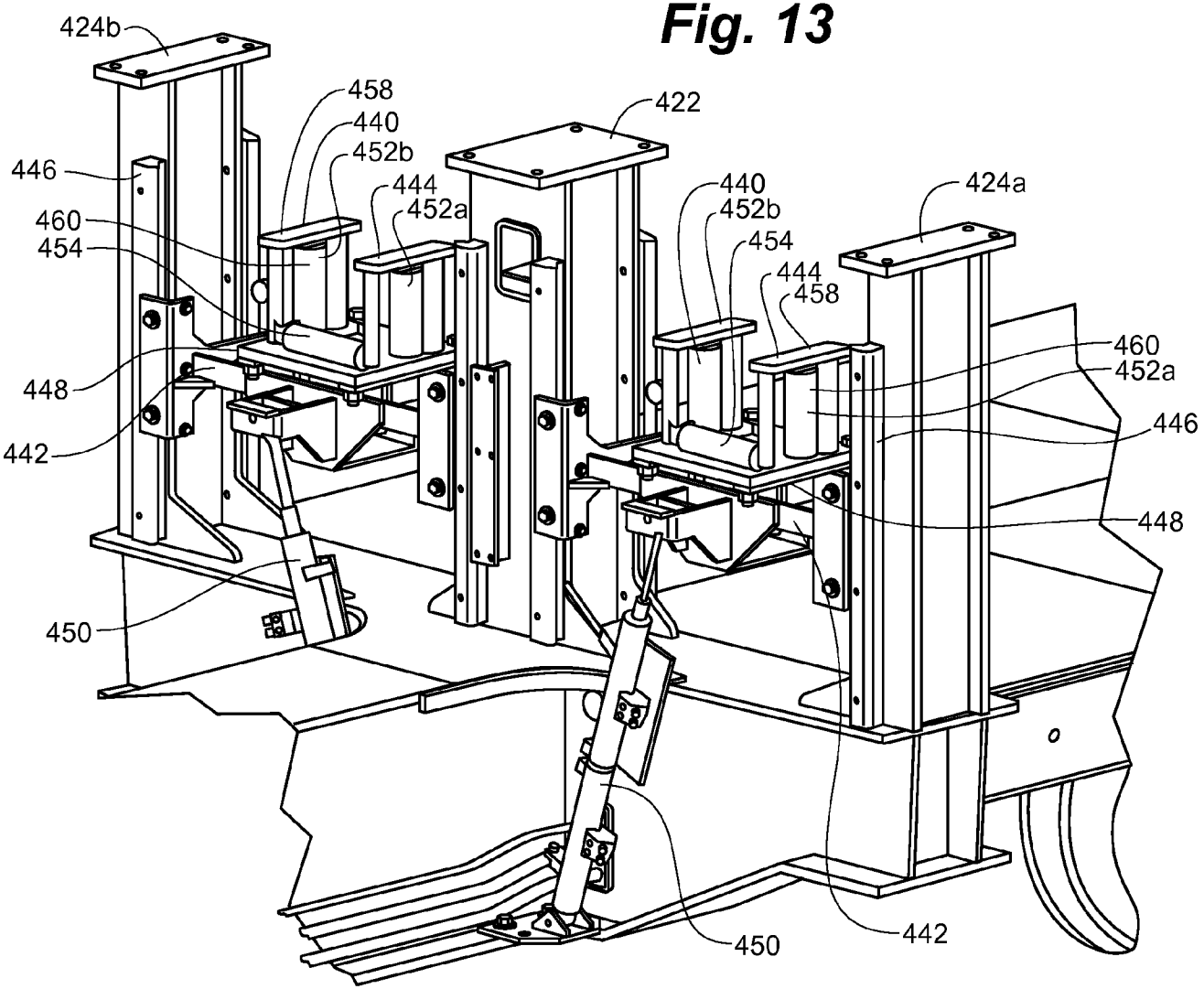
FIG. 13 is an expanded perspective view of an embodiment of a roller guide assembly.
Figure 14:
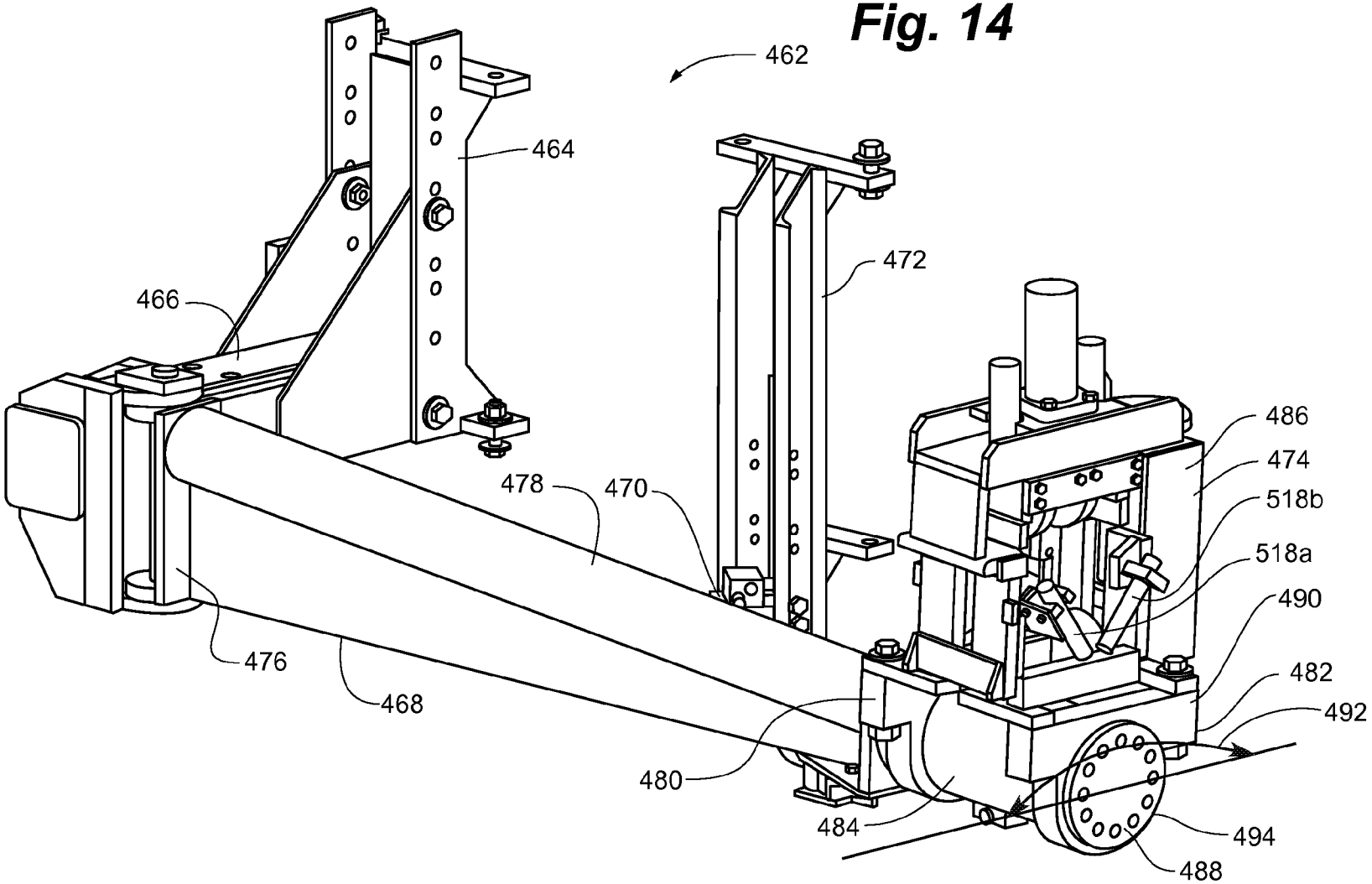
FIG. 14 is a perspective view of an embodiment of a rail manipulator for use with the chute car of FIG. 10.

Chute car 402 generally comprises a number of components to handle and manipulate rail. For instance, chute car 402 can comprise positionable roller guides 440 operably mounted between the center post 422 and exterior posts 424*a*, 424*b* of each of the chute car support structures 420*a*, 420*b* as illustrated in FIG. 13. Each positionable roller guide 440 comprises a guide frame 442 and a rail guide 444. Guide frame 442 attaches to the center post 422 and exterior posts 424*a*, 424*b* with a vertical track assembly 446. Rail guide 444 operably attaches to the guide frame 442 with a horizontal track assembly 448. Using a suitable biasing member such as, for example, a hydraulic cylinder 450, guide frame 442, and correspondingly rail guide 444 can be positioned at a desired height by biasing the guide frame 442 along the vertical track assembly 446. Similarly, rail guide 444 can be positioned at a proper horizontal position along the guide frame 442 using a biasing member to move the rail guide 444 along the horizontal track assembly 448. Proper horizontal and vertical positioning of the positionable roller guide 440 generally corresponds to the loading pocket 354 in which the long rail is being loaded or unloaded.

Rail guides 418*a*, 418*b* and rail guide 444 can comprise substantially similar designs in which a pair of vertically oriented roller assemblies 452*a*, 452*b* and a horizontally oriented roller assembly 454 are arranged to define a U-shaped guide opening 456. The vertically oriented roller assemblies 452*a*, 452*b* and horizontally oriented roller assembly 454 can comprise similar components including a roller frame 458 and a roller 460. Utilizing the weight of the long rail, vertically oriented roller assemblies 452*a*, 452*b* and horizontally oriented roller assembly 454 cooperatively guide the long rail as the long rail is rolled along the rollers 460 during loading and unloading of long rail from the rail transport train 300. In some embodiments, rail guides 418*a*, 418*b* and rail guide 444 can further comprise a rotatable horizontal cover assembly that can be rotatably positioned between the top portions of the vertically oriented roller assemblies 452*a*, 452*b* so as to fully enclose and capture long rail within the U-shaped guide opening 456.

Chute car 402 further comprises a rail manipulator 462 operably coupled within each of the open chute sections 416*a*, 416*b*. As illustrated in FIGS. 10, 14, 15 and 16, rail manipulator 462*a* comprises a manipulator mounting frame 464, an extension arm 466, a positioning arm 468, a swing arm 470, a swing arm mounting frame 472 and a rotator box assembly 474. Both the manipulator mounting frame 464 and swing arm mounting frame 472 are fixedly attached to the center sill 414. Extension arm 466 is fixedly coupled to the manipulator mounting frame 464 at one end and is pivotally coupled to the positioning arm 468 at the opposed end. Extension arm 466 assures that a pivoting end 476 of the positioning arm 468 remains extended away from the center sill 414. Swing arm 470 is operably mounted between the swing arm mounting frame 472 and a central portion 478 of the positioning arm 468 located between the pivoting end 476 and the rotator box assembly 474. Swing arm 470 comprises a linearly adjustable member such as, for example, a hydraulic or pneumatic cylinder, capable of increasing and decreasing the overall length of the swing arm 470 under the direction of a biasing force. Swing arm 470 can attach to the central portion 478 within a channel or track such that increasing and decreasing the length of swing arm 470 results in the positioning arm 468 rotating about pivoting end 476.

Rotator box assembly 474 is fixedly attached to positioning arm 468 at an end opposite of the pivoting end 476. Rotator box assembly 474 comprises a coupling frame 480 and a rotary guide assembly 482. Rotary guide assembly 482 comprises a rotatable actuator assembly 484 and a rail capture assembly 486. Rotatable actuator assembly 484 comprise a rotary actuator 488 and a rotary mounting frame 490. Rotary actuator 488 can comprise a hydraulic rotary actuator having a rotation range 492 of plus or minus 90° from a baseline configuration 494 shown in FIG. 14. Rail capture assembly 486 is fixedly attached to rotary mounting frame 490 such that the rail capture assembly 486 is rotatably positionable along rotation range 492.

Figure 15:
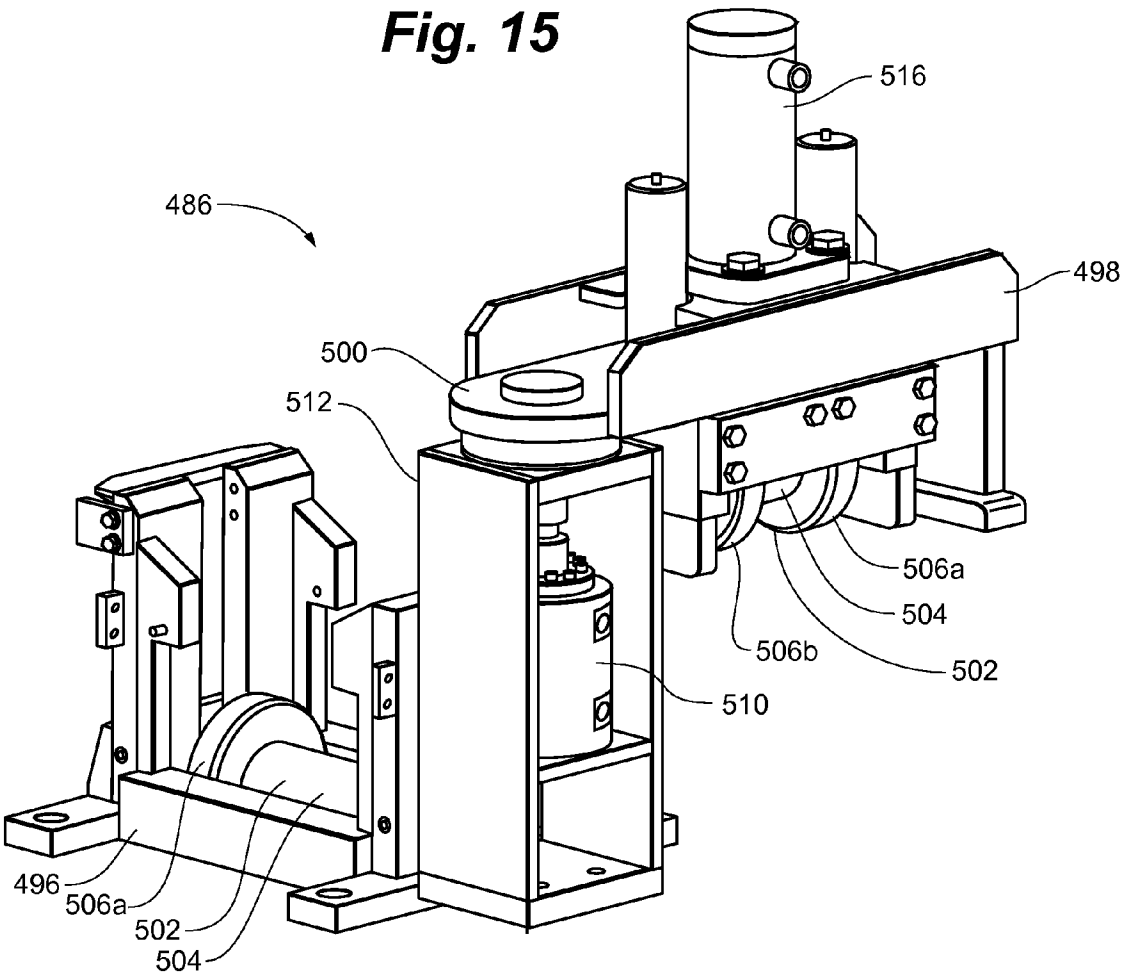
FIG. 15 is a perspective view of a rail capture assembly for use with the rail manipulator of FIG. 14 in a rail loading configuration.
Figure 16:
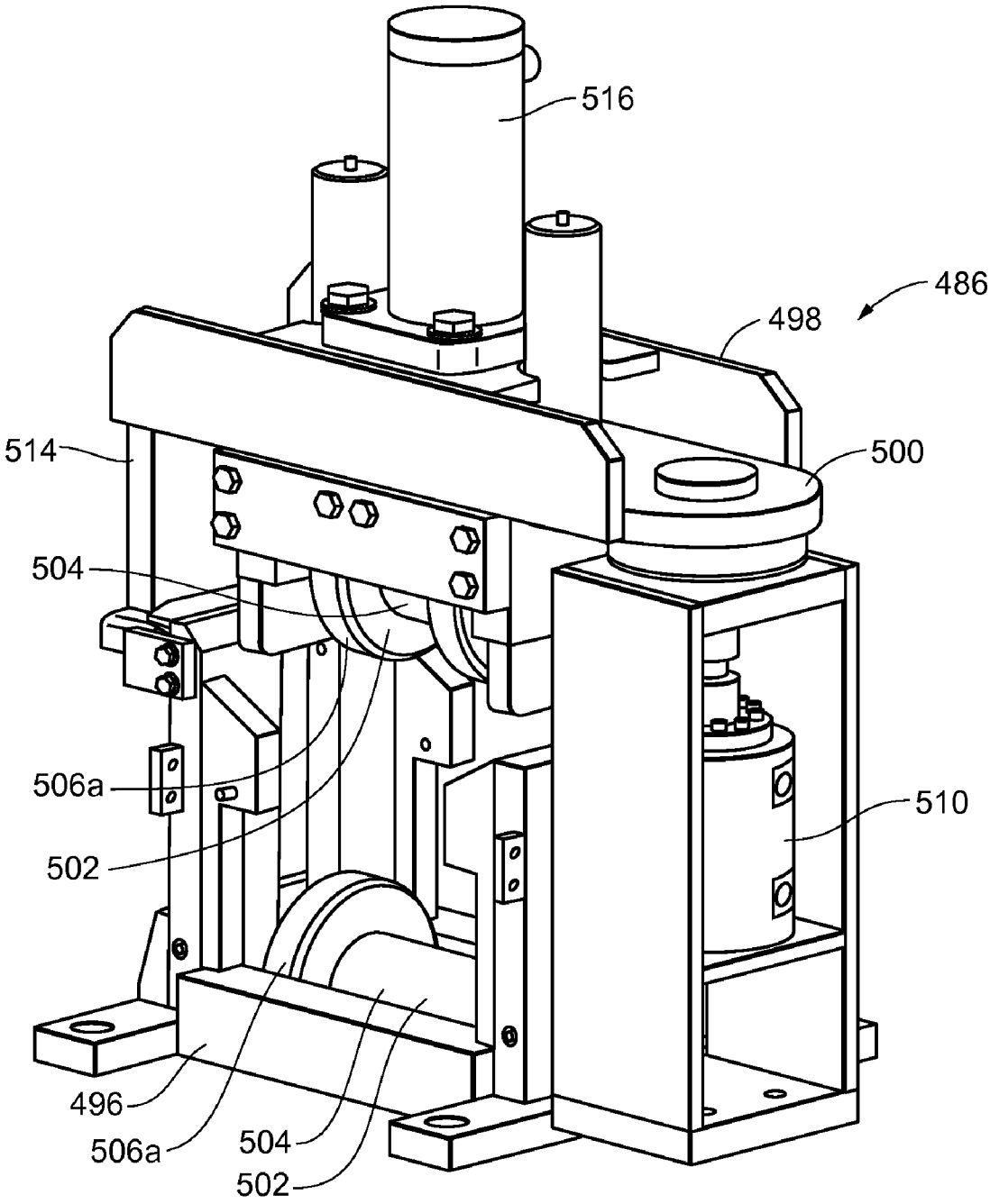
FIG. 16 is a is a perspective view of the rail capture assembly of FIG. 15 for use with the rail manipulator of FIG. 14 in a rail capture configuration.

As illustrated in FIGS. 15 and 16, rail capture assembly 486 comprises a fixed capture frame 496 and a pivoting capture frame 498 operably coupled and joined with a pivot assembly 500. Fixed capture frame 496 and pivoting capture frame 498 each include a capture roller 502 comprising a central roller portion 504 and end roller portions 506*a*, 506*b*. The central roller portion 504 has a roller length between the end roller portions 506*a*, 506*b* slightly exceeding the width of the long rail. Pivot assembly 500 comprises a rotary actuator 510 operably coupled to the pivoting capture frame 498 such that the pivoting capture frame 498 is pivotally positionable between a rail loading configuration 512 and a rail capture configuration 514. Pivoting capture frame 498 comprises a linear actuator 516 coupled to the capture roller 502 on pivoting capture frame 498. When rail is captured between the capture rollers 502 in the rail capture configuration 514, linear actuator 516 can apply pressure to the capture roller 502 on the pivoting capture frame 498 such that movement of the rail within the rail capture assembly 486 is substantially prevented. Fixed capture frame 496 can further comprise a pair of rail brushes 518*a*, 518*b* for sweeping debris such as, for example, rail bed ballast, from the long rail as the process of loading long rail on rail transport train 300 is performed.

Figure 17:
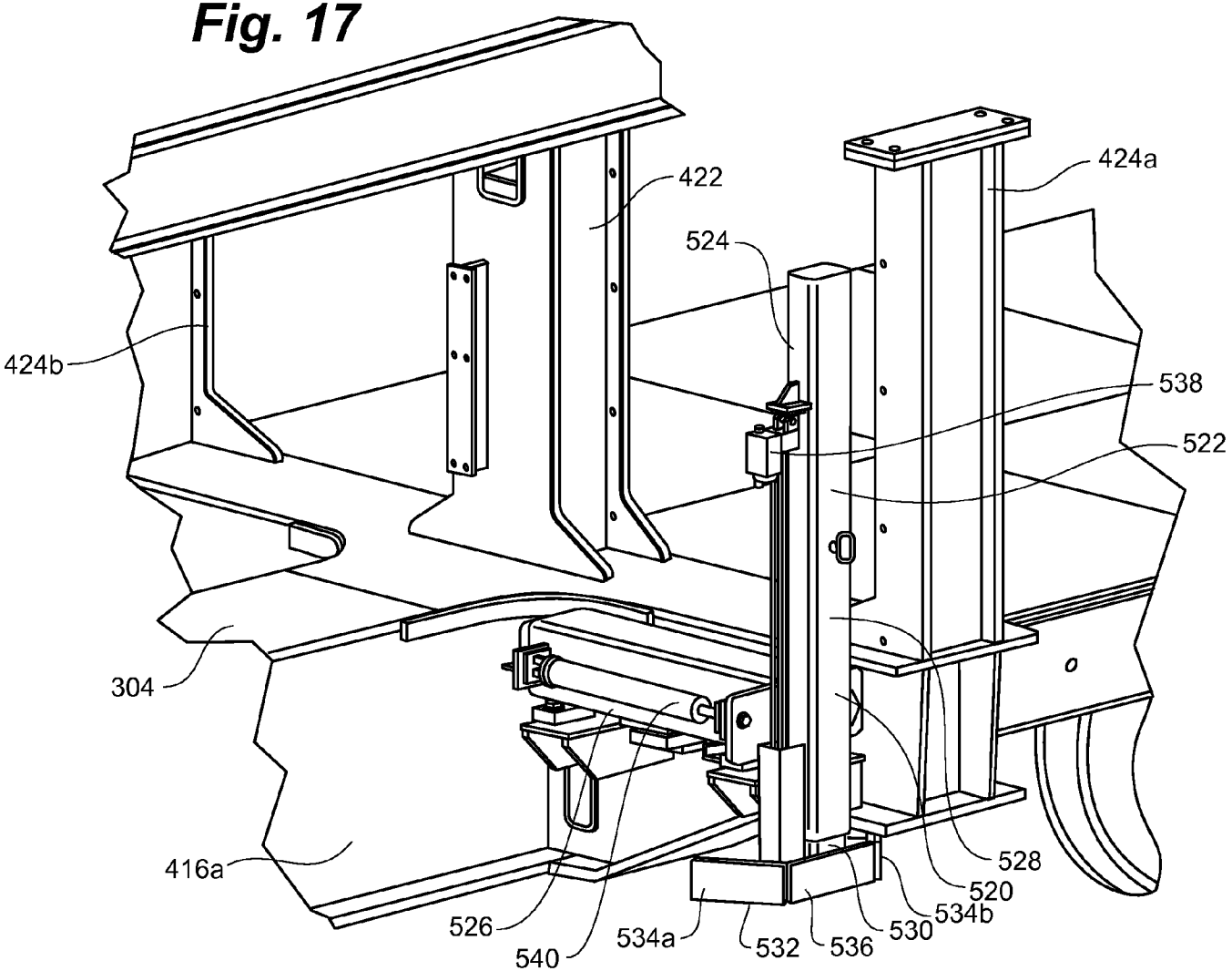
FIG. 17 is an expanded perspective view of an embodiment of a plow assembly for use with the chute car of FIG. 10.

As illustrated in FIGS. 10 and 17, chute car 402 can further comprise an adjustable rail plow 520 mounted to the platform frame 304 within each of the open chute sections 416*a*, 416*b*. Each adjustable rail plow 520 comprises a plow assembly 522, a vertical adjustment assembly 524 and a horizontal adjustment assembly 526. Plow assembly 522 comprises a plow housing 528, a plow arm 530 and a plow member 532. Plow arm 530 generally resides within the plow housing 528 and plow member 532 is fixedly attached to a bottommost end of the plow arm 530. Plow member 532 comprises a pair of angled plow surfaces 534*a*, 534*b* and a connecting surface 536. Vertical adjustment assembly 524 can comprise a vertical actuator 538 such as, for example, a hydraulic cylinder actuator, attached to the plow member 532 for selectively positioning the plow member 532 at a desired vertical location through slidable interaction of the plow arm 530 within the plow housing 528. Horizontal adjustment assembly 526 can comprise a horizontal actuator 540 such as, for example, a hydraulic cylinder or actuator, interconnecting the plow housing 528 and the platform frame 304 such that the plow assembly 522 can be horizontally positioned at a desired distance from the platform frame 304.

As illustrated in FIG. 12, work car 404 can comprise an electrical power enclosure 542, a hydraulic power enclosure 544, an operator enclosure 546 and a workstation 548. Work car 404 comprises a pair of work car support structures 550*a*, 550*b* for supporting a pair of work car gantry lanes 552*a*, 552*b*. Each work car support structure 550*a*, 550*b* comprises a center post 554 and a pair of exterior posts 556*a*, 556*b*. Work car gantry lanes 552*a*, 552*b* each comprise a central beam 558 and an exterior beam 560. In some embodiments, central beam 558 can be fabricated such the work car gantry lanes 552*a*, 552*b* share a common central beam 558.

Electrical power enclosure 542 can comprise an electrical generator for proving electrical power to various electrical components along the length of the long rail pick-up and delivery system 100. Hydraulic power enclosure 544 can comprise a hydraulic fluid source or hydraulic pump for supplying pressurized hydraulic fluid to various hydraulic components along the length of the long rail pick-up and delivery system 100. Operator enclosure 546 can comprise operator seating 562 such that operators can sit within the operator enclosure 546 during transport of the long rail pick-up and delivery system 100 as well as during certain portions of the loading and unloading of long rail from the rail transport train 300. Workstation 548 can comprise a generally open and accessible space for providing operators with an ability to work on long rail on the work car 404 in a safe and controlled location as opposed to working with long rail on the rail bed where the long rail may be unsecured and residing in unstable orientations. Workstation 548 can comprise suitable hydraulic and electrical supplies such that workstation 548 can be used as a cutting station, a drilling station, a welding station and a bolting station for performing mechanical operations on long rail.

At each end of work car 404, a pair of rail capture assemblies 564*a*, 564*b* are positioned on the work platform 408 so as to captively retain long rail on both ends and on both sides of the work car 404. Rail capture assemblies 564*a*, 564*b* can be substantially similar to the rail capture assembly 486 mounted on rail manipulators 462*a*, 462*b*. The rail capture assemblies 564*a*, 564*b* are positioned off the floor of work platform 408 so as to position long rail with both a first pair of rail positioning boxes 566*a*, 566*b* and a second pair of rail positioning boxes 568*a*, 568*b*. The first pair of rail positioning boxes 566*a*, 566*b* and the second pair of rail positioning boxes 568*a*, 568*b* are spaced apart from each other such that corresponding rail positioning boxes are physically located on opposed sides of the work station 548.

Figure 18:
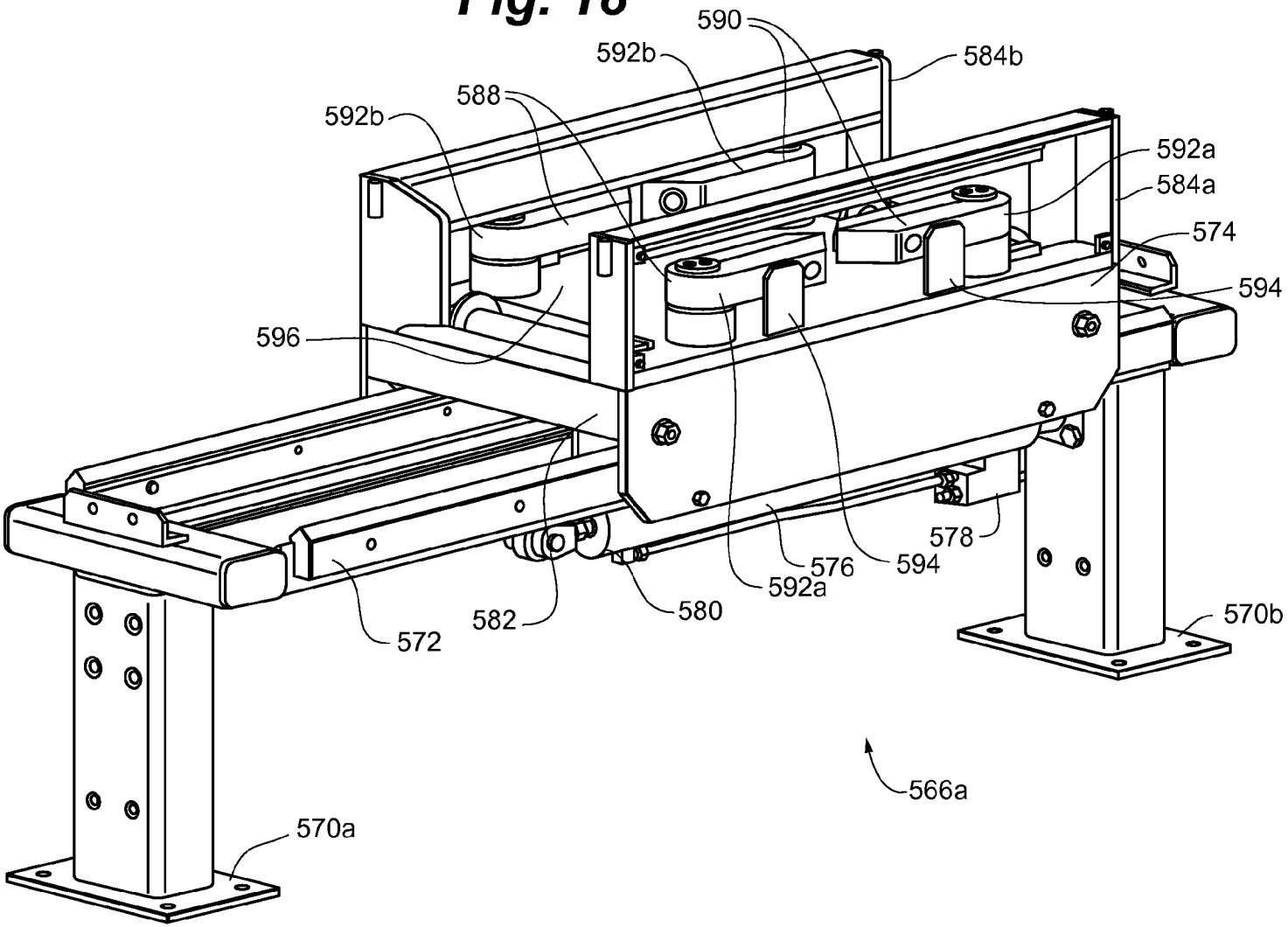
FIG. 18 is a perspective view of an embodiment of a rail positioning box for use with the work car of FIG. 12.
Figure 19:
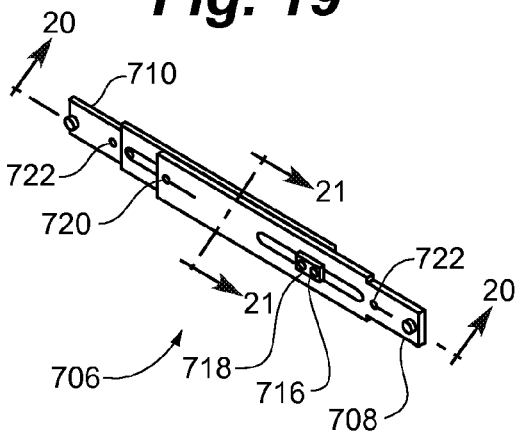
FIG. 19 is a perspective view of an embodiment of an expansion beam assembly.
Figure 20:
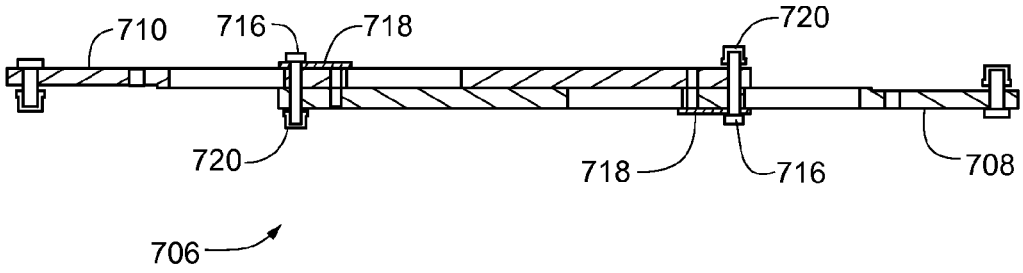
FIG. 20 is a section view of the expansion beam assembly taken at line 20-20 of FIG. 19.
Figure 21:
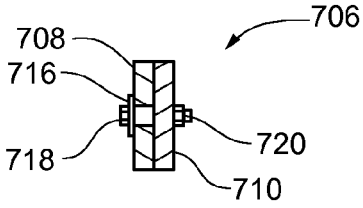
FIG. 21 is a section view of the expansion beam assembly taken at line 21-21 of FIG. 19.
Figure 22:
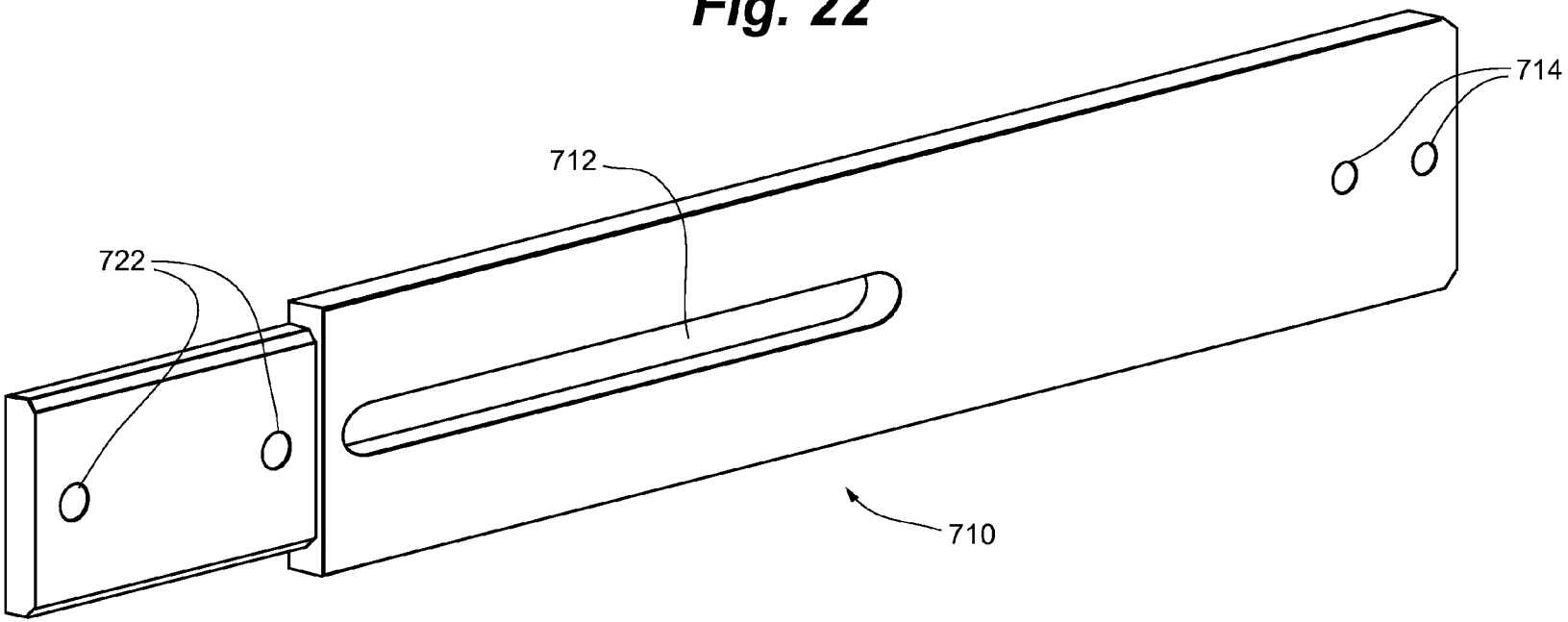
FIG. 22 is a perspective view of an expansion beam member for use with the expansion beam assembly FIG. 19.

Representative rail positioning box 566*a* is further illustrated in FIG. 18 and comprises a pair of legs 570*a*, 570*b*, a horizontal track 572, a positioning assembly 574 and a positioning actuator assembly 576. Horizontal track 572 is attached to the legs 570*a*, 570*b* with positioning assembly 574 operably mounted on the horizontal track 572. Positioning actuator assembly 576 comprises an actuator 578 and a hydraulic cylinder 580. Hydraulic cylinder 580 is attached at one end to the horizontal track 572 and at the other end to the positioning assembly 574. Using hydraulic cylinder 580, positioning assembly 574 can be horizontally located at any position along the horizontal track 572. Positioning assembly 574 comprises a positioning frame 582, a pair of wall frames 584*a*, 584*b* and at least one positioning roller 586. A first clamping assembly 588 and a second clamping assembly 590 are pivotally mounted within the wall frames 584*a*, 584*b*. First clamping assembly 588 and second clamping assembly 590 each comprise a pair of opposed, rotatable clamp members 592*a*, 592*b* and a pivot stop 594 to prevent exterior movement of the rotatable clamp members 592*a*, 592*b* outside the footprint of the positioning frame 582. The rotatable clamp members 592*a*, 592*b* are operably attached to a rotator assembly such that the rotatable clamp members can be rotated inward to a rail positioning area 596 defined between the wall frame 584*a*, 584*b*. During loading and unloading of long rail from the rail transport train 300, long rail is positioned to roll along the at least one positioning roller 586 in the rail positioning area. If an operator desires to perform work on the long rail such as, for example, cutting, drilling station, welding station and/or bolting of the long rail, the rotator assembly can actuate the first clamping assembly 588 and second clamping assembly 590 such that the rotatable clamp members 592*a*, 592*b* rotate inwards and clamp the long rail within the rail positioning area 596. As the rotatable clamp members 592*a*, 592*b* on the first clamping assembly 588 and second clamping assembly 590 rotate inwardly to clamp in opposed directions relative to the long rail, a camming-style grip prevents movement of the long rail in either direction within the rail positioning area 596 is resisted. When the long rail is captively retained by the first clamping assembly 588 and second clamping assembly 590, precise positioning of the long rail can be accomplished by moving the positioning assembly 574 along the horizontal track 572. The first pair of rail positioning boxes 566*a*, 566*b* and second pair of rail positioning boxes 568*a*, 568*b* cooperatively fix the position of the long rail relative to the workstation 548 on the work car 404. By incorporating the workstation 548 on the work car 404, safety and productivity is improved by moving the rail operations from track level to the work car 404 where the long rail is firmly clamped and precisely positioned without risking injury to the operators.

Transition car 406 performs the function of transitioning the long rail between the work car 404 and the rail transport train 300 during either a loading or unloading operation. As illustrated in FIG. 11, transition car 406 comprises a first transition car end 598 and a second transition car end 600. First transition car end 598 is generally positioned adjacent the work car 404 while the second transition car end 600 is positioned adjacent an end transport car 312 on the rail transport train 300. Transition car 406 comprises a pair of transition car support structures 602*a*, 602*b*. Each transition car support structure 602*a*, 602*b* comprises a center post 604 and a pair of exterior posts 606*a*, 606*b*. Transition car support structures 602*a*, 602*b* support a pair of transition car gantry lanes 608*a*, 608*b*. Transition car gantry lanes 608*a*, 608*b* each comprise a central beam 610 and an exterior beam 612. In some embodiments, central beam 610 can be fabricated such that the transition car gantry lanes 608*a*, 608*b* share a common central beam 610. A pair of fixed rail guides 613*a*, 613*b* are attached to transition car support structure 602*a*. Each fixed rail guide 613*a*, 613*b* comprise a guide support member 614 mounted between the center post 604 and the corresponding exterior post 606*a*, 606*b*. Attached to the guide support member 614 is a rail guide 616 substantially resembling rail guide 444 in appearance and operation. A pair of adjustable rail guides 618*a*, 618*b* are attached to transition car support structure 602*b*. Each adjustable rail guide 618*a*, 618*b* comprise a vertically positionable support member 620 mounted between the center post 604 and the corresponding exterior post 606*a*, 606*b*. Attached to the vertically positionable support member 620 is rail guide 616. A pair of vertical actuator assemblies 622*a*, 622*b* are operably connected between the platform frame 304 and the vertically positionable support members 620. The positionable support members 620 are operably mounted to vertical tracks 624 attached to the center post 604 and exterior posts 606*a*, 606*b* of the transition car support structure 602*b*. Adjustable rail guides 618*a*, 618*b* are operably mounted on a horizontal track 626 on the vertically positionable support members 620. Through the use of the vertical actuator assemblies 622*a*, 622*b* and a horizontal actuator assembly providing for horizontal placement of the adjustable rail guides 618*a*, 618*b* along the horizontal track 626 of the vertically positionable support members 620, the adjustable rail guides 618*a*, 618*b* can be vertically and horizontally positioned to correspond with the loading pocket 354 on rail transport train 300 that is being loaded or unloaded.

As illustrated in FIG. 1, gantry system 700 spans the length of the rail transport train 300 and the work unit 400. As shown in FIG. 2, gantry system 700 comprises a pair of elevated gantries 702*a*, 702*b* operating on a pair of continuous gantry lanes 704*a*, 704*b*. The continuous gantry lanes 704*a*, 704*b* are constructed by interconnecting the gantry lanes of adjacent cars with an expansion beam assembly 706 along the entire length of rail transport train 300 and work unit 400.

Figure 23:
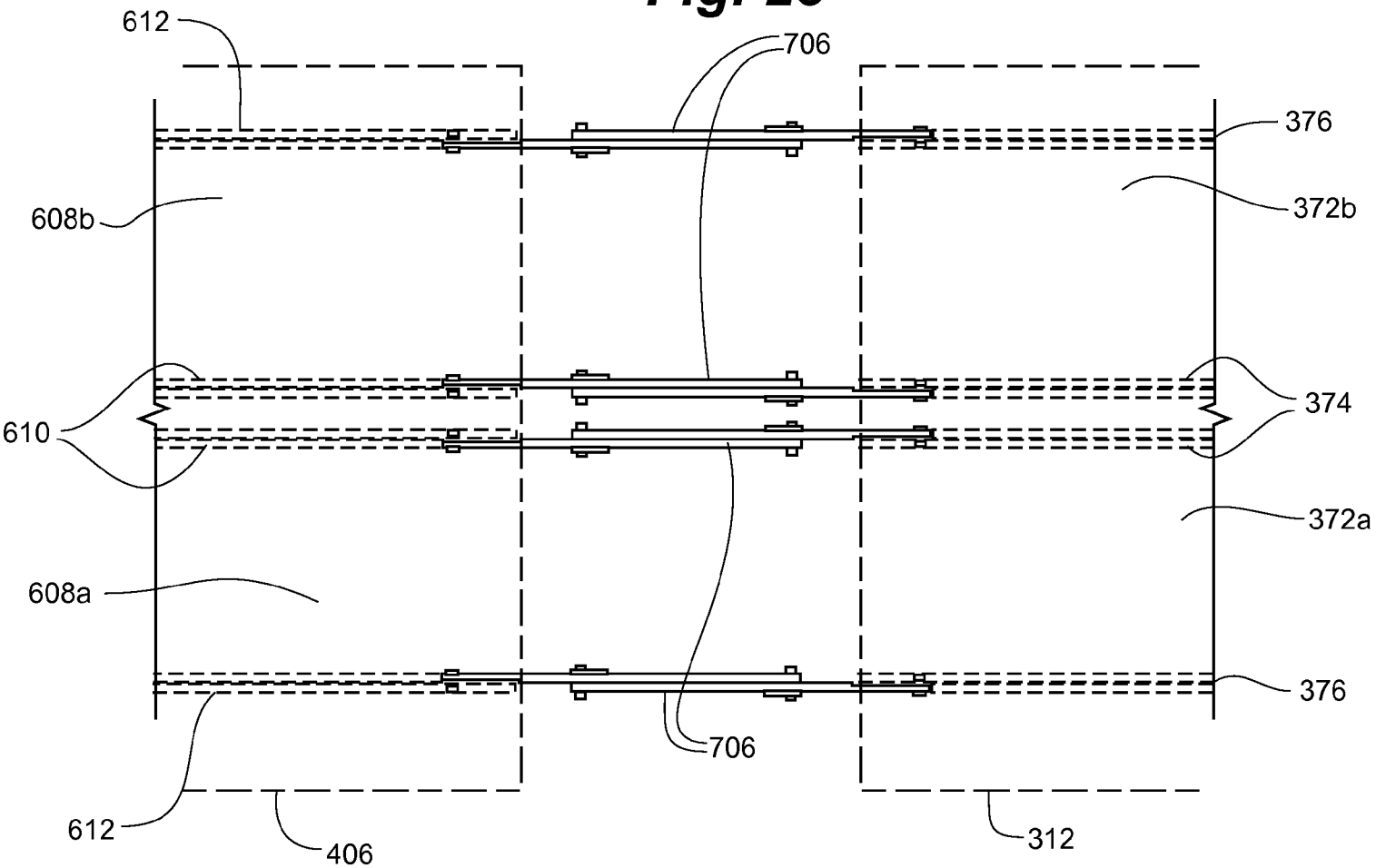
FIG. 23 is a top view of four expansion beam assemblies of FIG. 19 interconnected between gantry lanes on adjacent rail cars.
Figure 24:
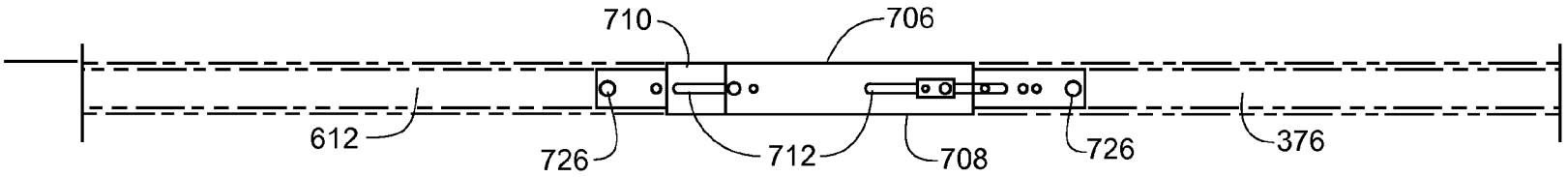
FIG. 24 is a side view of one expansion beam assembly of FIG. 19 interconnected between gantry lanes on adjacent rail cars.

As illustrated in FIGS. 19, 20, 21 and 22, expansion beam assembly 706 comprises a first expansion beam member 708 and a second expansion beam member 710. First expansion beam member 708 and second expansion beam member 710 are substantially identical in appearance. First expansion beam member 708 and second expansion beam member 710 each include an expansion slot 712 and slider throughbores 714. First expansion beam member 708 and second expansion beam member 710 are operably, slidably connected at two locations with a pair of slider assemblies 716, each slider assembly 716 interconnecting one expansion slot 712 and one slider throughbore 714. The slider assemblies 716 each comprise a threaded interconnecting slide 718 and a lock nut 720. When connected with both slider assemblies 716, first expansion beam member 708 and second expansion beam member 710 are capable of slidable translation while remaining operably connected. Both first expansion beam member 708 and second expansion beam member 710 comprise mounting throughbores 722 such that the expansion beam assembly 706 can be operably interconnected between beams on adjacent cars for interconnecting the various gantry lanes to define the continuous gantry lanes 704*a*, 704*b*. For instance, as illustrated in FIGS. 23 and 24, four expansion beam assemblies 706 are operably interconnected between the transition car 406 and the end transport car 312. The four expansion beam assemblies 706 operably interconnect the rail car gantry lanes 372*a*, 372*b* with the transition car gantry lanes 608*a*, 608*b* by interconnection of the central beams 374 with the central beams 610 and the exterior beams 376 with the exterior beams 612. Central beams 374, central beams 610, exterior beams 376 and exterior beams 612 all comprise beam throughbores 724 such that fastening members 726 can be operatively connected through the mounting throughbores 722 and beam throughbores 724. It is to be understood that this process of installing the expansion beam assembly 706 is repeated between each adjacent car along the length of the rail transport train 300 and work unit 400 such that the various gantry lanes such as, for example, the chute car gantry lanes 426*a*, 426*b*, the work car gantry lanes 552*a*, 552*b*, transition car gantry lanes 608*a*, 608*b* and rail car gantry lanes 372*a*, 372*b*, are operably interconnected to form the continuous gantry lanes 704*a*, 704*b*.

Figure 25:
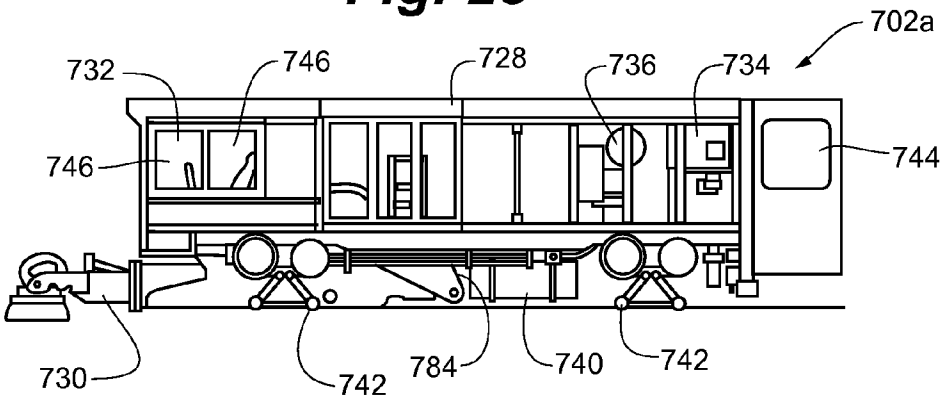
FIG. 25 is a side view of an embodiment of an elevated gantry.
Figure 26:
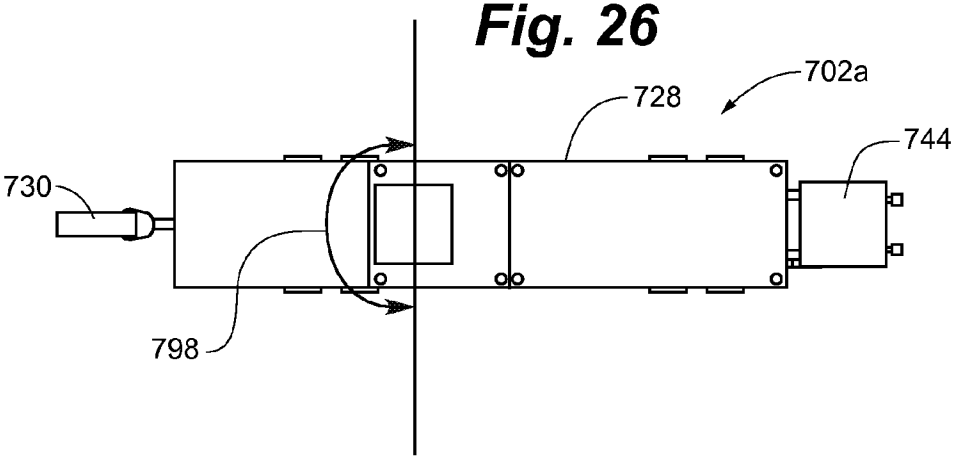
FIG. 26 is a top view of the elevated gantry of FIG. 25.
Figure 27:
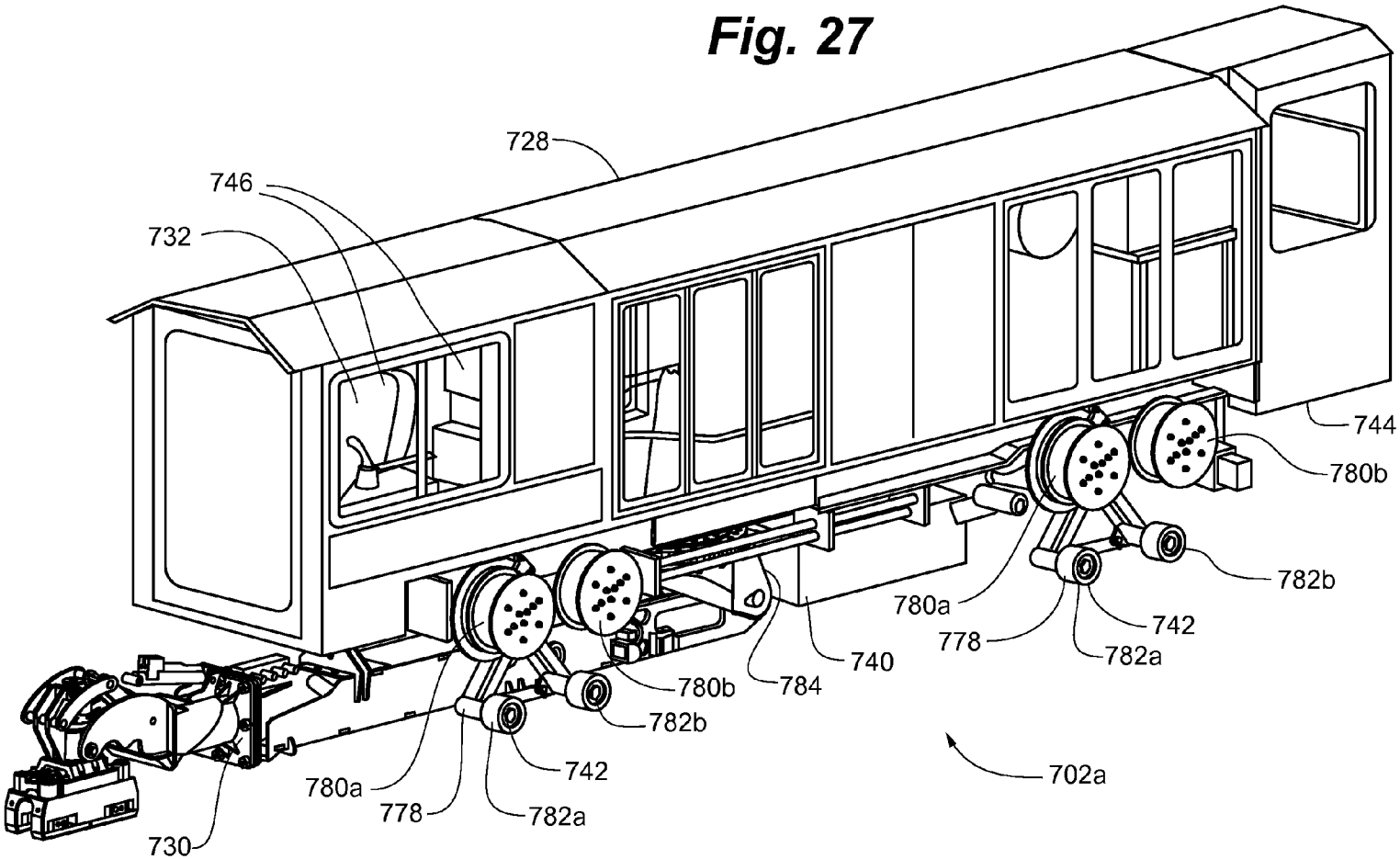
FIG. 27 is a perspective view of the elevated gantry of FIG. 25.

Elevated gantries 702*a*, 702*b* can comprise substantially identical gantries wherein elevated gantry 702*a* is operable along the length of gantry lane 704*a* and elevated gantry 702*b* is operable along the length of gantry lane 704*b*. Elevated gantry 702*a* is illustrated in FIGS. 25, 26 and 27 and generally comprises a gantry body 728 and a gantry boom 730. Gantry body 728 can comprise an operator cab 732, an electric system 734, a hydrostatic system 736, a diesel engine 738, a fuel tank 740, a drive system 742 and a rail loading cab 744.

Figure 28:
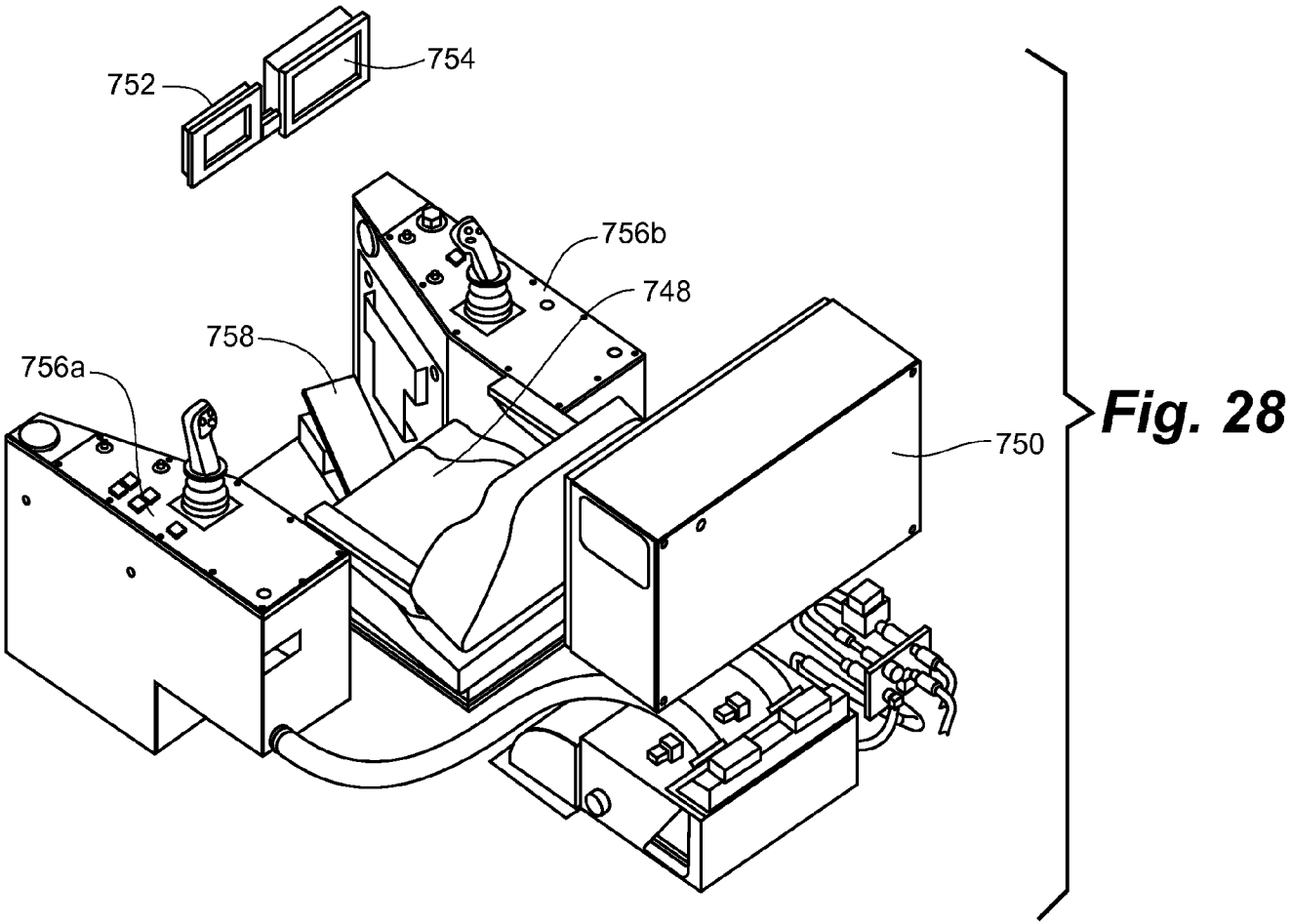
FIG. 28 is a perspective view of an interior layout of an operator cab within the elevated gantry of FIG. 25.

Operator cab 732 comprises a plurality of operator windows 746 to provide an operator with a clear view of the work being performed by the elevated gantry 702*a*. As illustrated in FIG. 28, an interior portion of operator cab 732 further comprises a seat 748, an environmental system 750, a touch screen control interface 752, a video display 754, a pair of boom control panels 756*a*, 756*b* and a gantry throttle pedal 758. Environmental system 750 can comprise heating and air conditioning equipment suitable to maintain comfortable operating conditions within the operator cab 732. Touch screen interface 752 can provide system information pertaining to the long rail pick-up and delivery system 100 and allow an operator to communicate information to other system operators such as, for example, operators on work car 404, within elevated gantry 702*b* and the diesel locomotive 202. Video display 754 can provide a live video feed from a video camera positioned on rail loading cab 744. Boom control panels 756*a*, 756*b* include representative control elements for operating the gantry boom 730 such as, for example, joysticks, buttons, lights, and switches. Gantry throttle pedal 758 can communicate with drive system 742 such that elevated gantry 702*b* moves along gantry lane 704*a*.

Figure 29:
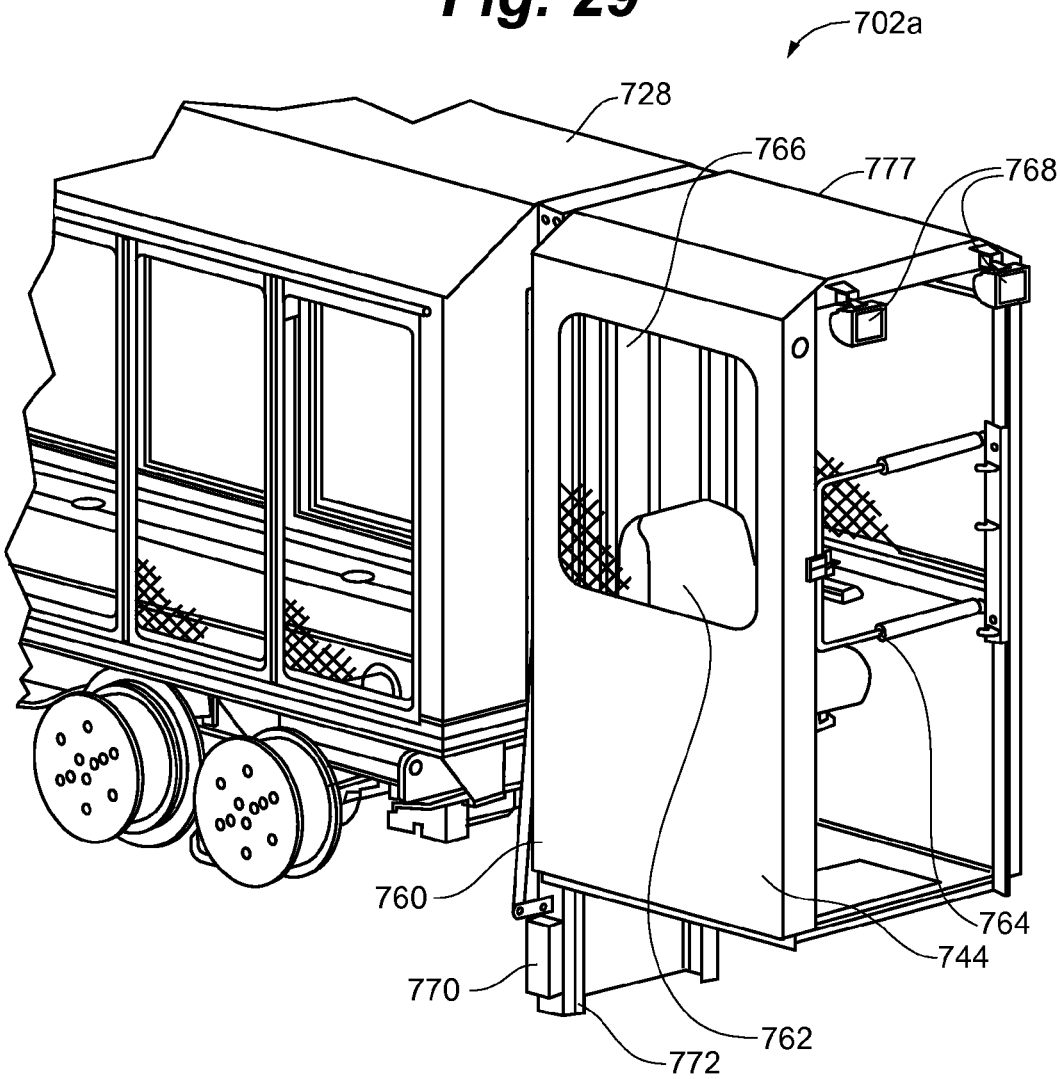
FIG. 29 is an expanded, perspective view of a rail loading cab on the elevated gantry of FIG. 25 in a vertical up position.
Figure 30:
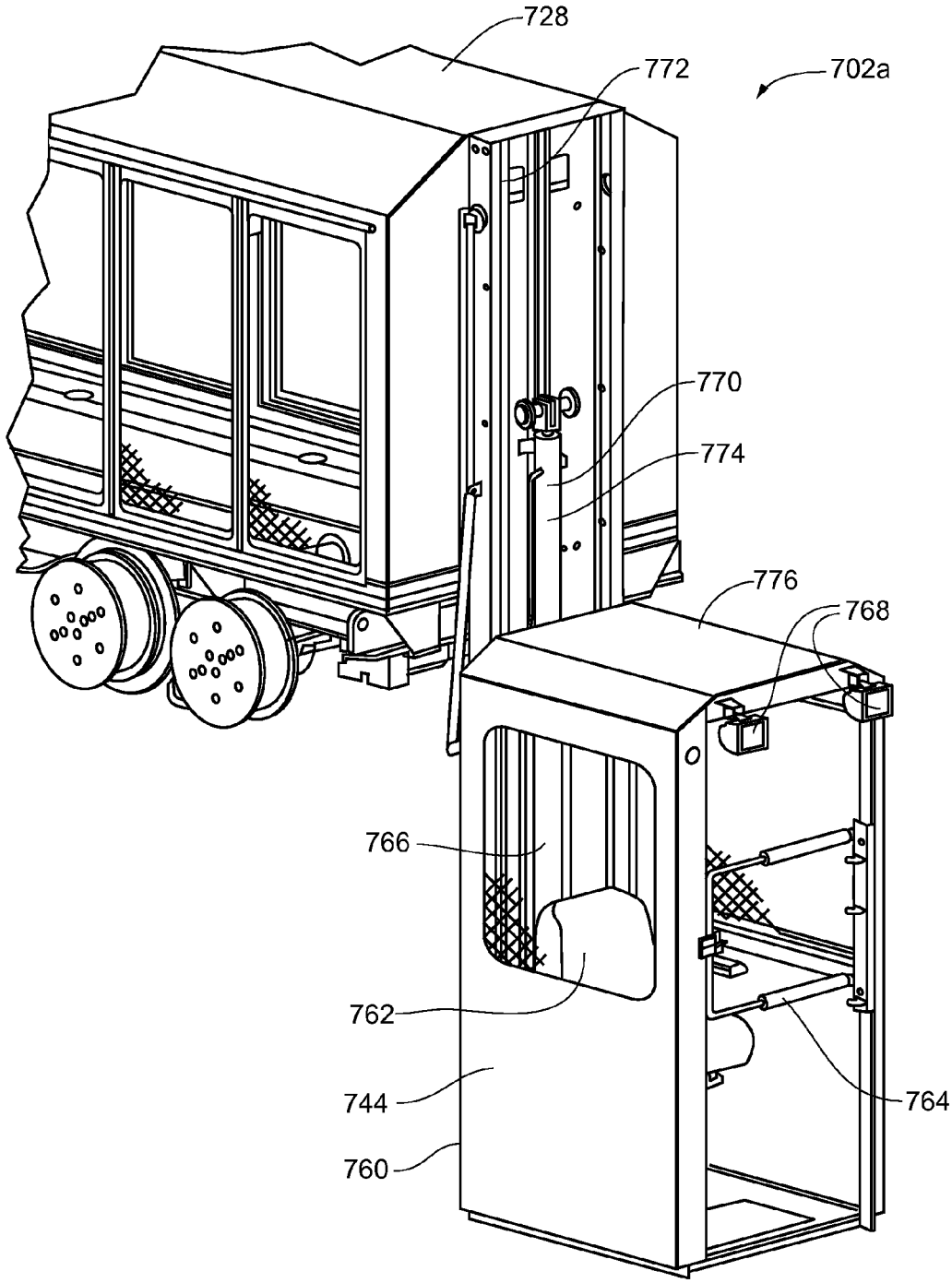
FIG. 30 is an expanded perspective view of a rail loading cab on the elevated gantry of FIG. 25 in a vertical down position.

As illustrated in FIGS. 29 and 30, rail loading cab 744 can comprise a cab body 760 having a cab seat 762, a rotatable safety gate 764, cab windows 766 and cab lights 768. Cab body 760 is operably attached to the gantry body 728 with a vertical cab positioning assembly 770. Vertical cab positioning assembly 770 can comprise a vertical mounting track 772 and a vertical actuator 774 such as, for example, a vertical hydraulic cylinder. Vertical mounting track 772 is attached to the cab body 760 and the gantry body 728 such that the rail loading cab 744 can be positioned in a vertical down position 776, as illustrated in FIG. 30, and a vertical up position 777 as illustrated in FIG. 29.

Figure 31:
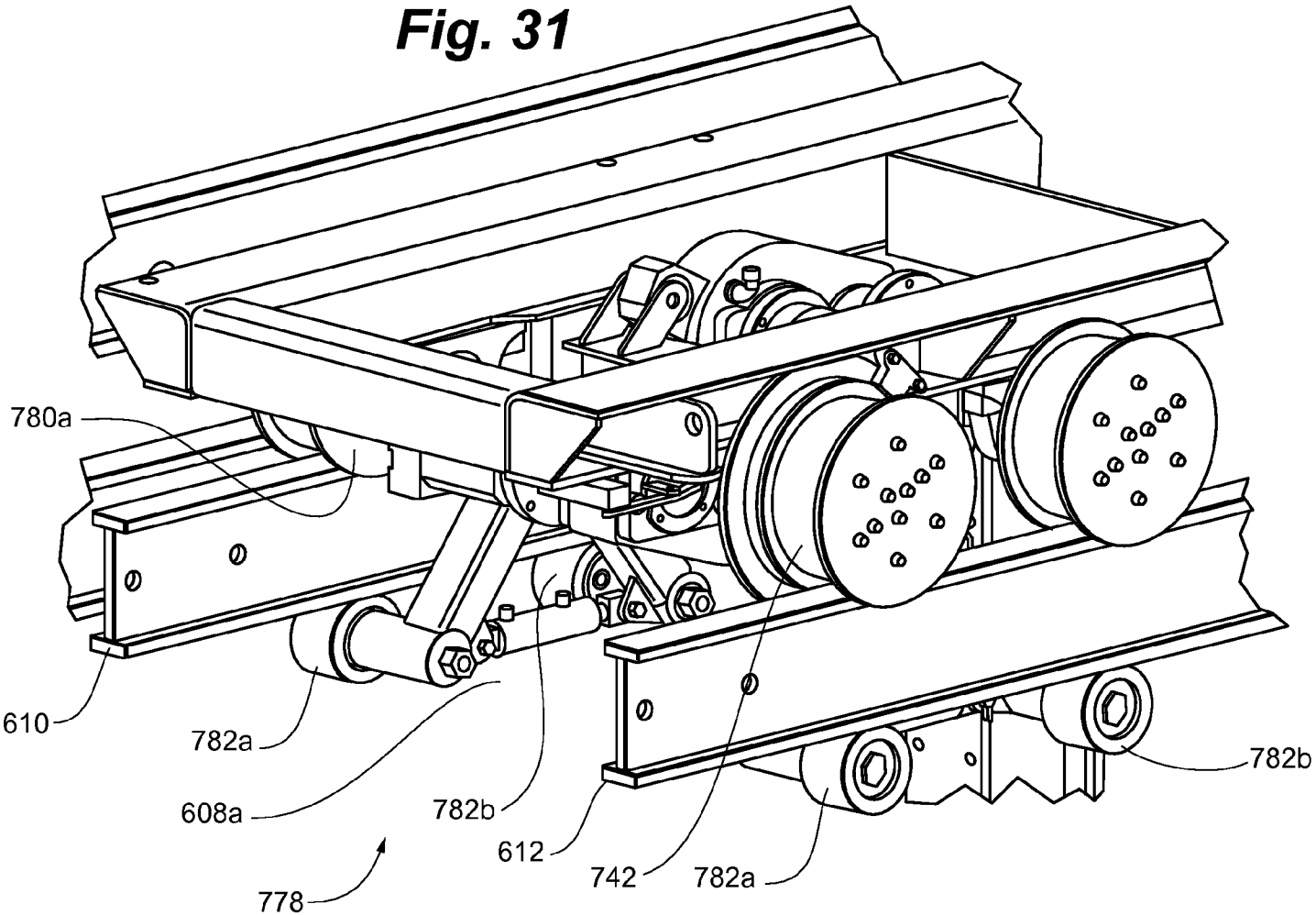
FIG. 31 is an expanded perspective view of a drive system on the elevated gantry of FIG. 25 interfacing with an elevated gantry lane.

As illustrated in FIG. 31, drive system 742 generally comprises a pair of gantry wheel assemblies 778 for operably interfacing with opposing sides of the beams comprising continuous gantry lanes 704*a*, 704*b*. Each gantry wheel assembly 778 comprise a pair of top wheels 780*a*, 780*b* and a pair of lower wheels 782*a*, 782*b*. Top wheels 780*a*, 780*b* can each comprise a tire made from a friction enhancing polymer such as, for example, polyurethane or other suitable polymers, to enhance the frictional interface between the gantry wheel assemblies 778 and the continuous gantry lanes 704*a*, 704*b*. Through the use of top wheels 780*a*, 780*b* and bottom wheels 782*a*, 782*b*, the elevated gantries 702*a*, 702*b* are retained on opposed sides of the beams such as, for example, interior beam 610 and exterior beam 612 making up the continuous gantry lanes 704*a*, 704*b* such that derailment of the elevated gantries 702*a*, 702*b* is prevented.

Figure 32:
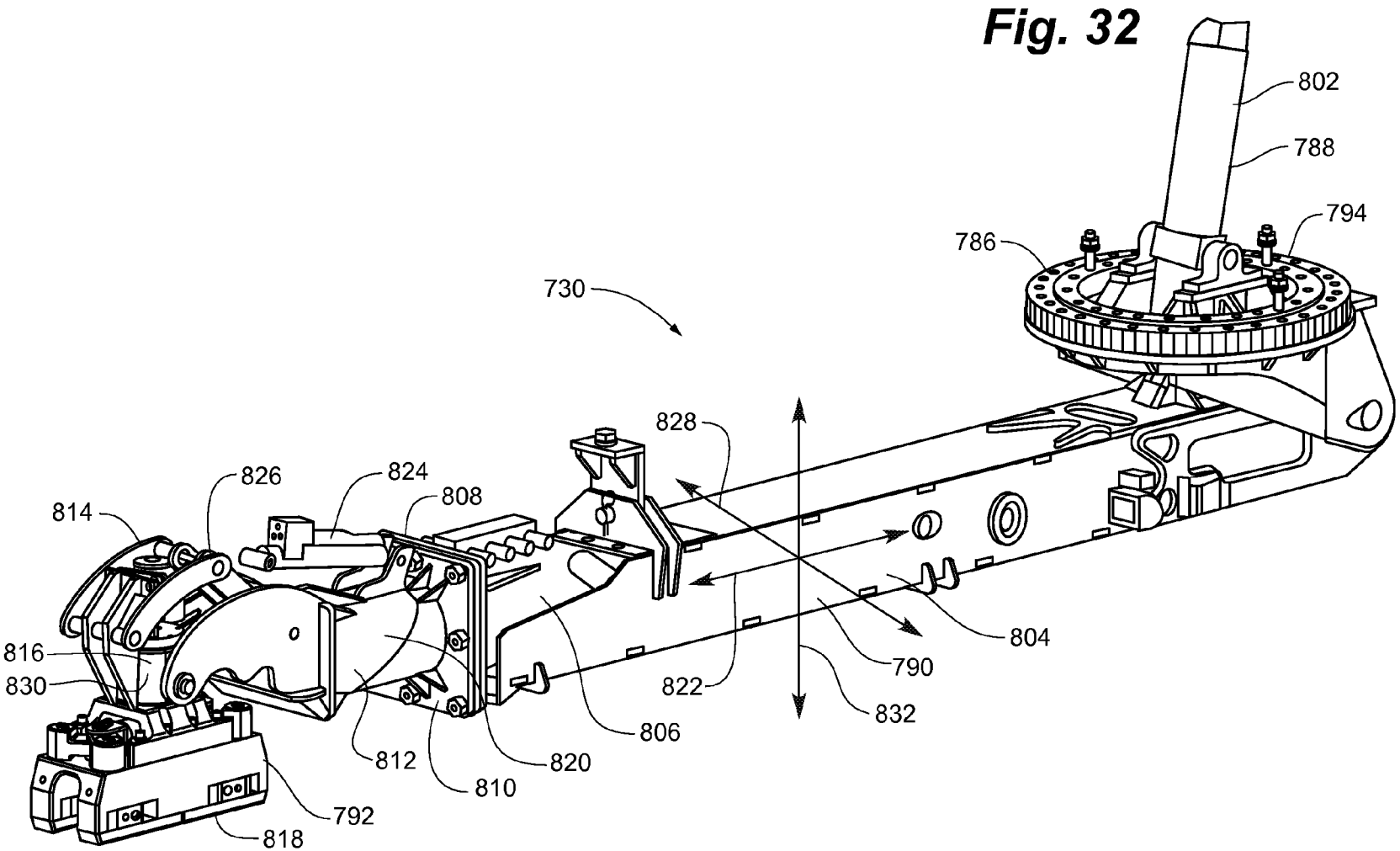
FIG. 32 is a perspective view of an embodiment of a gantry boom.
Figure 33:
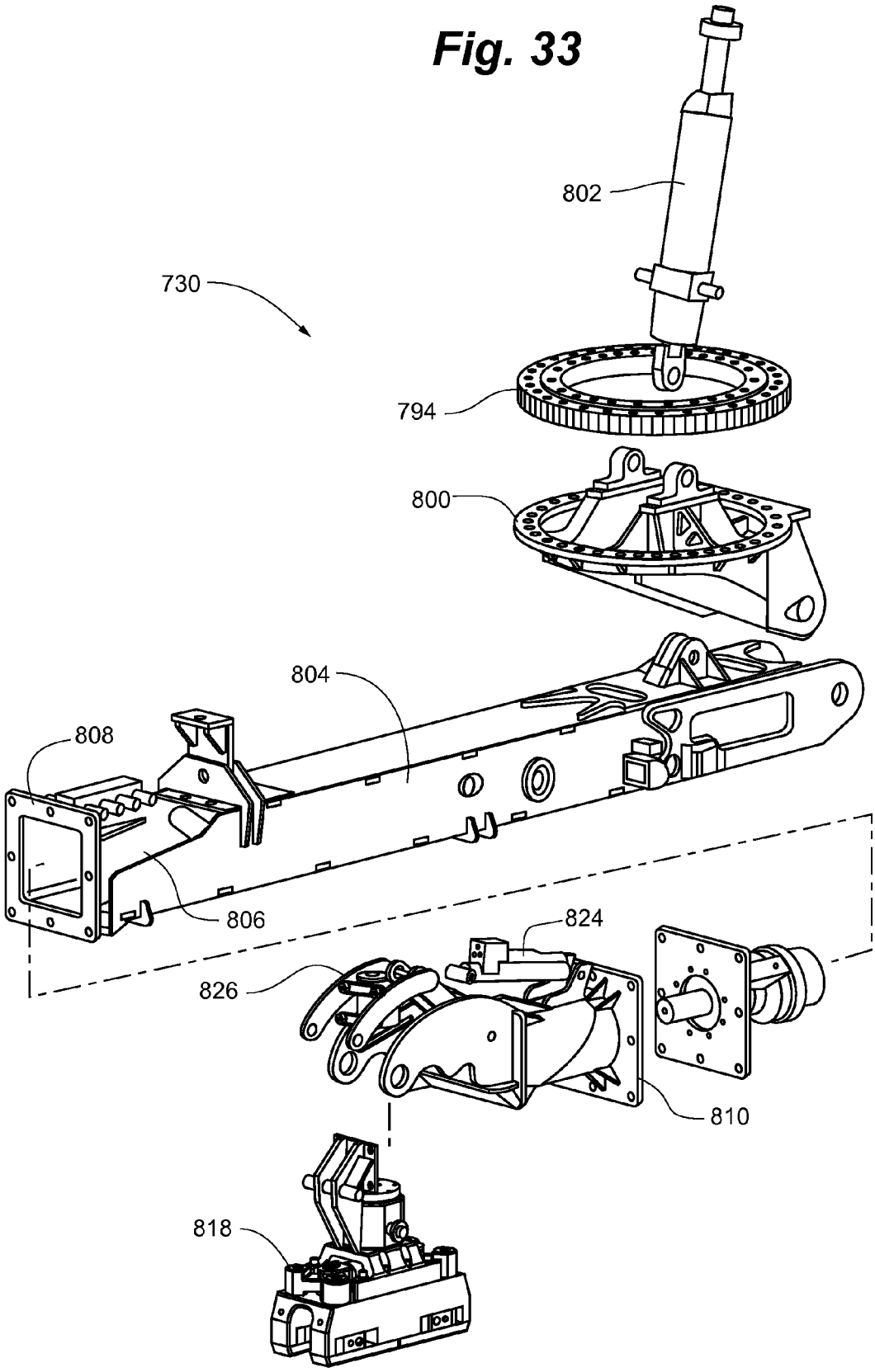
FIG. 33 is an exploded perspective view of the gantry boom of FIG. 32.

Gantry boom 730 is operably mounted to a gantry turret 784 below the gantry body 728. As illustrated in FIGS. 32 and 33, gantry boom 730 generally comprises a turret mounting assembly 786, a vertical adjustment assembly 788, a telescoping boom arm assembly 790 and a gripping head assembly 792.

Turret mounting assembly 786 generally comprises a splined turret mount 794. Splined turret mount 794 can interface with a corresponding splined turret receiver on the gantry body 728. Through interconnection of the splined turret mount 794 and the splined turret receiver, gantry boom 730 can comprise a rotatable boom swing range 798 of 180° as illustrated in FIG. 26.

Vertical adjustment assembly 788 comprises a pivoting bracket 800 and a vertical actuator 802 such as, for example, a hydraulic cylinder. Pivoting bracket 800 operably interconnects the telescoping boom arm assembly 790 with the turret mounting assembly 786. Vertical actuator 802 is operably attached between the gantry body 728 and the telescoping boom arm assembly 790. When directed, vertical actuator 802 pushes downward or pulls upward on the telescoping boom arm assembly 790 causing the telescoping boom arm assembly to pivot about pivoting bracket 800.

Telescoping boom arm assembly 790 comprises an exterior arm housing 804 and an internal arm member 806. Internal arm member 806 operably slides inward and outward from the exterior arm housing 804 to increase or decrease the overall length of telescoping boom arm assembly 790. Internal arm member 806 can partially reside within a track or channel internal to the exterior arm housing 804 such that a linear actuator such as, for example, a hydraulic cylinder can slidably position the internal arm member 806. Internal arm assembly 806 can comprise a flanged arm connector 808 for attaching the gripping head assembly 792 to the telescoping boom arm assembly 790.

Gripping head assembly 792 can comprise a flanged gripping head connector 810, a rotary gripping head roll assembly 812, a linear gripping head pitch assembly 814 and a rotary gripping head yaw assembly 816 and a gripping head 818. Flanged gripping head connector 810 operably interconnects the gripping head assembly 792 to the flanged arm connector 808 on the telescoping boom arm assembly 790. Rotary gripping head roll assembly 812 comprises a rotary actuator 820 for controlling position of the gripping head 818 about a roll axis 822 of the telescoping boom arm assembly 790. Linear gripping head pitch assembly 814 comprises a linear actuator 824 mounted between the flanged gripping head connector 810 and a pivoting gripper bracket 826. As the linear actuator 824 moves forward and back, pivoting gripper bracket 826 causes the gripping head 818 to move about a pitch axis 828 of the telescoping boom arm assembly 790. Rotary gripping head yaw assembly 816 comprises a rotary actuator 830 operably mounted between the gripping head 818 and the pivoting gripper bracket 826. Rotary gripping head yaw assembly 816 controls the positioning of the gripper head 818 about a yaw axis 832 of the telescoping boom arm assembly 790.

Figure 34:
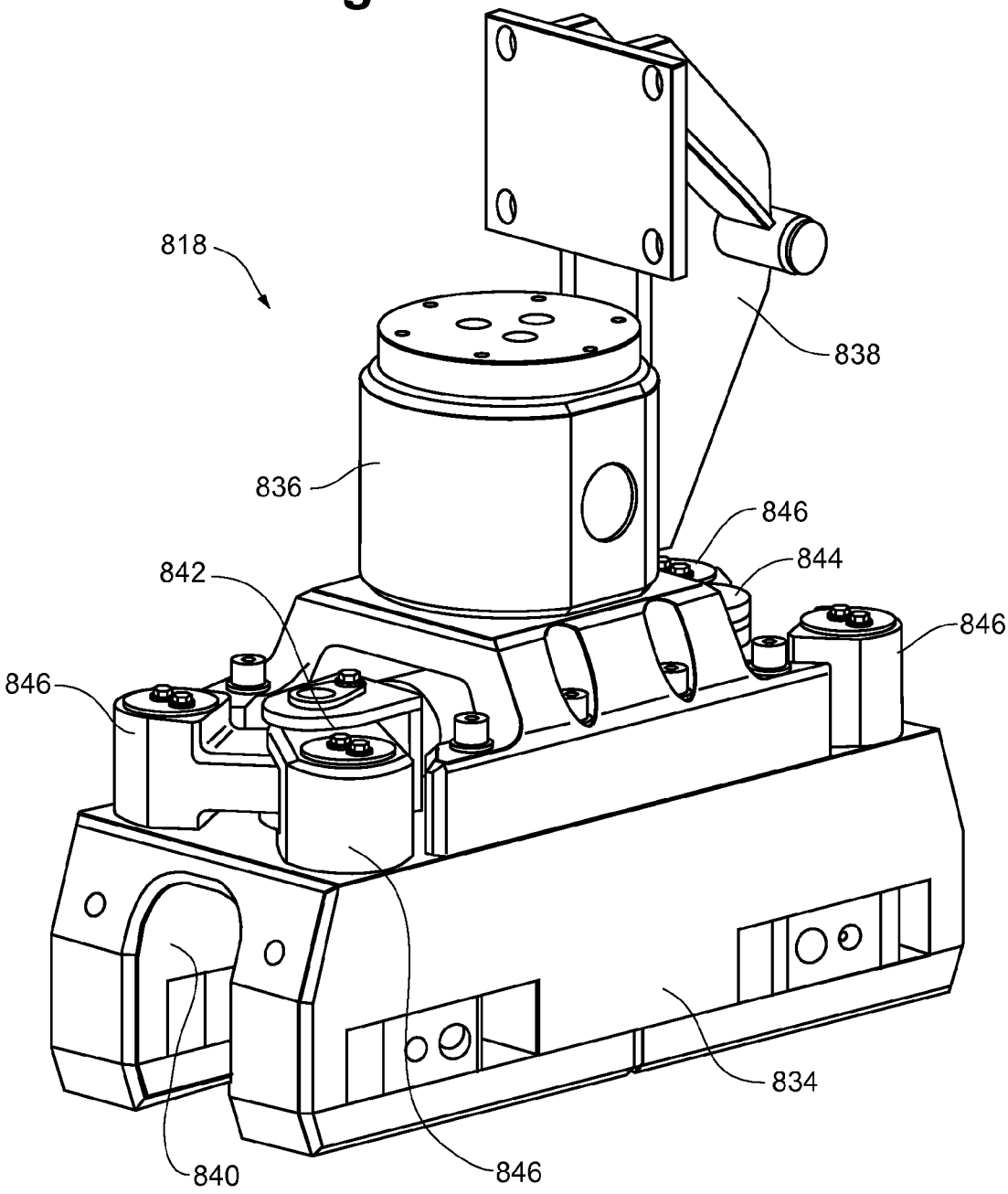
FIG. 34 is a perspective view of a gripping head for use with the gantry boom of FIG. 32.

As illustrated in FIG. 34, gripper head 818 generally comprises a gripper body 834, a rotary yaw interface 836 and a pivoting pitch interface 838. Gripper body 834 comprises a gripper channel 840 extending the length of the gripper body 834. Gripper channel 840 is sized so as to capture and retain long rail. Gripper body 834 further comprises a first clamping assembly 842 and a second clamping assembly 844. First clamping assembly 842 and second clamping assembly 844 each comprise a pair of rotatable clamp members 846. First clamping assembly 842 and second clamping assembly 844 can substantially resemble first clamping assembly 588 and second clamping assembly 590 wherein the rotatable clamp members 846 are rotatably positioned to grasp rail with the gripper channel 840. The rotatable clamp members 846 on the first clamping assembly 842 and second clamping member 844 are arranged to grip in opposed directions such that the long rail is positively retained within the gripper channel 840.

Gantry boom 730 provides an operator with seven degrees of freedom relative to positioning the gripper head 818 for grasping, retaining and pulling long rail along the long rail pick-up and delivery system 100. The seven degrees of freedom for the gantry boom 730 include rotational freedom provided by the turret mounting assembly 786, elevational freedom provided by the vertical adjustment assembly 788, the reaching distance freedom of the telescoping boom arm assembly 790, the roll freedom provided by the rotary gripping head roll assembly 812, the pitch freedom provided by the linear gripping head pitch assembly 814, the yaw freedom provided by the rotary gripping head yaw assembly 816 and the gripping freedom provided by the first clamping assembly 842 and second clamping assembly 844. Through these seven degrees of freedom, gripper head 818 can be oriented to grip and retain long rail regardless of the rail orientation and even at distances up to 12 feet from the railbed center and up to 4 feet below top of rail.

In use, long rail pick-up and delivery system 100 can be used to either deliver new lengths of rail 102*a*, 102*b* to a work site or remove used lengths of rail 102*a*, 102*b* from a work site. As shown in FIG. 1, integrated power plant 200 is used to pull and position the rail transport train 300 and the work unit 400 at the work site. In some instances, integrated power plant 200 and work unit 400 can already be located at the work site and a rail operator will deliver the rail transport train 300, in either a loaded or unloaded configuration, to the work site with a standard locomotive. At that point, rail transport train 300 is operably connected to the work unit 400. During transport, rail transport train 300 and work units 400, the various gantry lanes such as, for example, rail car gantry lanes 372*a*, 372*b*, chute car gantry lanes 432*a*, 432*b*, work car gantry lanes 552*a*, 552*b* and transition car gantry lanes 608*a*, 608*b*, are operably connected using a plurality of expansion beam assemblies 706 (a quantity of four expansion beam assemblies between each adjacent car) to form continuous gantry lanes 704*a*, 704*b*. As the rail transport train 300 and work unit 400 are transported to the work site, the first expansion beam members 708 and second expansion beam members 710 slidably interact along the expansion slots 712 to accommodate changes in elevation and track curves along the length of the rail transport train 300 and work unit 400. Alternatively, the plurality of expansion beam assemblies can be installed to form the continuous gantry lanes 704*a*, 704*b* after the integrated power plant 200 has positioned the rail transport train 300 and work unit 400 at the work site.

As shown in FIG. 1, long rail pick-up and delivery system 100 is positioned on a rail track 900. Alongside of rail track 900 are long rails 102*a*, 102*b* ready for loading onto the long rail pick-up and delivery system 100. Long rails 102*a*, 102*b* can have variable lengths, for example three hundred feet to a quarter mile in length. Long rails 102*a*, 102*b* can be staged such that their end points correspond alongside the rail track 900 or long rails 102*a*, 102*b* may be staged such that their end points do not correspond. Based on the rail size, long rails 102*a*, 102*b* can weigh from 112 to 141 pounds per rail yard.

For purposes of describing the operation of long rail pick-up and delivery system 100, operation will be described with reference to elevated gantry 702*a*. It is to be understood that elevated gantry 702*b* operates in a similar manner but independently of elevated gantry 702*a*. It is to be understood that the processes of loading and unloading long rails 102*a*, 102*b* as described below can be simultaneously and independently performed along both sides of long rail pick-up and delivery system 100 through the use of both elevated gantries 702*a*, 702*b*.

With reference to loading an empty rail transport train 300 with used long rail 102*a*, long rail pick-up and delivery system 100 is generally positioned as shown in FIG. 1. Elevated gantry 702*a* traverses the continuous gantry lane 704*a* under the power of diesel engine 738 such that the elevated gantry 702*a* is generally adjacent an end of the long rail 102*a*. An operator in the operator cab 732, manipulates the gantry boom 730 with the boom control panels 756*a*, 756*b* such that the turret mounting assembly 786, vertical adjustment assembly 788 and telescoping boom arm assembly 790 position the gripping head assembly 792 proximate the long rail 102*a*. Regardless of the resting orientation of the long rail 102*a*, gripper channel 840 can be positioned over long rail 102*a* through the combination of the rotary gripping head roll assembly 812, linear gripping head pitch assembly 814 and rotary gripping head yaw assembly 816. After the long rail 102*a* is positioned within the gripper channel 840, first clamping assembly 842 and second clamping assembly 844 are actuated to grip and retain the long rail 102*a* within the gripper channel 840.

After elevated gantry 702*a* has grasped the long rail 102*a*, the operator orients the long rail 102*a* for loading onto the chute car 402. Chute car 402 can be loaded over the first chute car end 410 or between the axles through open chute section 416*a*. Loading over first chute car end 410 is generally performed when the long rail 102 is residing with the rail bed such as, for example, when the rail line is being abandoned or replaced. When loading over the first chute car end 410, the elevated gantry 702*a* lifts and sets the long rail 102*a* within the rail guide 418*a* such that the long rail 102*a* can be set upon horizontally oriented roller assembly 454 and between vertically oriented roller assemblies 452*a*, 452*b*. The operator can then direct the elevated gantry 702*a* toward chute car support structure 420*b* such that the long rail rolls within rail guide 418*a*.

Alternatively, long rail 102*a* can be loaded between the axles through open chute section 416*a*. Loading long rail through open chute section 416*a* is advantageous when long rail 102*a* lies outside the rail bed or when the long rail 102*a* is in a non-upright orientation such as, for example, laying sideways or at an angle. The operator grasps long rail 102*a* using gantry boom 730 and manipulates the gripping head 818 proximate the open chute section 416*a*. Rail manipulator 462 is then utilized to adjust the orientation of the long rail 102*a* to an upright orientation for proper loading along rail transport train 300. Swing arm 470 pushes upon positioning arm 468 such that the rotator box assembly 474 is proximate the long rail 102. Rotary actuator 488 rotates the rotator box assembly 474 such that the capture roller 502 on the pivoting capture frame 498 corresponds to a top surface of the long rail while capture roller 502 on the fixed capture frame 496 corresponds to a bottom surface of the long rail. Pivot assembly 500 rotatably opens the pivoting capture frame 498 to the rail loading configuration 512 such that the gantry boom 730 can place long rail 102*a* within the rail capture assembly 486. Pivot assembly 500 then rotatably closes the pivoting capture frame 498 to the rail capture configuration 514. Linear actuator 516 directs capture roller 502 on the pivoting capture frame 498 against the top surface of long rail 102*a* such that the long rail 102*a* is retainably captured between both capture rollers 502. Swing arm 470 retracts directing the positioning arm 468 proximate the center sill 414. Through the use of rail manipulator 462, long rail 102*a* can be properly oriented when lying in non-upright orientations without relying solely upon the gantry boom 730.

After the long rail 102*a* has been loaded within either of rail guide 418*a* or rail capture assembly 486, elevated gantry 702*a* pulls long rail 102*a* and positions the long rail within positionable roller guide 440 in a similar manner as previously described with reference to rail guide 418*a*. Positionable roller guide 440 is variably positioned to correspond with the selected loading pocket 354 for long rail 102*a*. Through the combination of vertical track assembly 446 and hydraulic cylinder 450, guide frame is vertically positioned to correspond with the height of the loading pocket 354 while the horizontal track assembly 448 and a horizontal actuator horizontally position the rail guide 444 to correspond with a horizontal location of the loading pocket 354. Once long rail 102*a* has been loaded into rail guide 444, elevated gantry 702*a* pulls long rail 102*a* to work car 404 by rolling across the expansion beam assemblies 706 connecting the chute car gantry lane 426*a* with the work car gantry lane 552*a*.

Elevated gantry 702*a* pulls long rail 102*a* onto the work car 404 wherein the long rail is positioned within rail capture assembly 564*a*. Elevated gantry 702*a* continues traversing the work car gantry lane 552*a* such that and sequentially feeds the long rail 102*a* through the first pair of rail positioning boxes 566*a*, 566*b*. When elevated gantry 702*a* is pulling rail through the first pair of rail position boxes 566*a*, 566*b*, the first clamping assembly 588 and second clamping assembly 590 are in an open position such that the rotatable clamp members 592*a*, 592*b* do not engage the long rail 102*a*. After feeding the first pair of rail positioning boxes 566*a*, 566*b*, elevated gantry 702*a* positions the long rail 102*a* within the rail capture assembly 564*b*. Elevated gantry 702*a* the pulls long rail 102*a* to transition car 406 by rolling across the expansion beam assemblies 706 connecting the work car gantry lane 552*a* and the transition car gantry lane 608*a*.

In the event that work is to be performed on the long rail 102*a* at workstation 548, the first clamping assembly 588 and second clamping assembly 590 on the first pair of rail positioning boxes 566*a*, 566*b* engage the long rail 102*a* to fixedly retain the long rail 102*a*. As the rotatable clamp members 592*a*, 592*b* of the first clamping assembly 588 and second clamping assembly 590 grip in opposed directions, an opposed camming action is applied to the long rail 102*a* such that the long rail 102*a* cannot move in either direction. Once long rail 102*a* is retainably captured within the first pair of rail positioning boxes 566*a*, 566*b*, the gripping head 818 on gantry boom 730 releases the long rail 102*a* wherein the positioning actuator assembly 576 can move the positioning frame 582 along the horizontal track 572 for precise positioning of the long rail 102*a* over the work station 548. Examples of when the first pair of rail positioning boxes 566*a*, 566*b* are utilized can be when the length of the long rail 102*a* exceeds the length of the loading pocket 354 and a cutting operation must be performed at work station 548 to create two sections of long rail. Another example is when two sections of long rail are joined with a suitable fastening process, to make a single length of long rail corresponding to the length of loading pocket 354. After the work has been accomplished at workstation 548, gripping head 818 regrasps the long rail 102*a* and continues with the loading operation.

On transition car 406, the elevated gantry 702*a* traverses the transition car gantry lane 608 so as to load the long rail 102*a* within rail guide 616 and adjustable rail guide 618*a*. Adjustable rail guide 618*a* provides for final vertical and horizontal alignment of the long rail 102*a* before loading onto rail transport train 300. Using vertical track 624 and horizontal track 626, adjustable rail guide 618*a* is aligned with the desired loading pocket 354. Once long rail 102*a* has been loaded into adjustable rail guide 618*a*, elevated gantry 702*a* pulls long rail 102*a* to the rail transport train 300 by rolling across the expansion beam assemblies 706 connecting the transition car gantry lane 608*a* with the rail car gantry lane 372*a*.

As the elevated gantry 702*a* pulls the long rail 102*a* onto the rail train 300, the lowermost rail rack 324 on each rack support system 318*a*, 218*b* is placed in rail supporting configuration 348 with the above rail racks 324 placed in the rail loading configuration 346. In addition, bulkhead doors 358 on the end transport cars 312 are rotatably attached to the bulkhead loading column 362. Positioning of the rail racks 324 and bulkhead doors 358 can be accomplished by an operator climbing onto the platform frame 304 or alternatively, by lowering the rail loading cab 744 to vertical down position 776 as the elevated gantry 702 traverses the continuous gantry lane 704*a*. An operator in rail loading cab 744 can open the rotatable safety gate 764 and step or reach out of the rail loading cab 744 to access the rail racks 324 and bulkhead doors 358 as well as the rail tie downs 352 on rail clamp car 316.

When loading the rail transport train 300, the loading pockets 354 on the lowermost rail rack 324 are loaded first. Elevated gantry 702*a* traverses the length of the rail transport train 300 and positions the long rail 102*a* within the desired loading pocket 354 and on either corresponding roller assemblies 350 or rail tie down of the rack support systems 318*a*, 318*b*. When elevated gantry 702*a* reaches the end of rail transport train 300, the long rail 102*a* is clamped into position on the rail clamp car 316 with rail tie down 352. Clamping the long rail 102*a* in a single location in the middle of rail transport train 300 provides for slack at both ends of the long rail 102*a* while limiting forward and back movement of the long rail 102*a* on the rail transport train 300. Gantry boom 730 releases the long rail 102*a* such that elevated gantry 702*a* can traverse the length of rail transport train 300 and work unit 400 so as to grab and load the next length of long rail. At the same time, elevated gantry 702*b* can operate on gantry lane 704*b* to pick up and position long rail 102*b* independently of the operation of the elevated gantry 702*a*.

As the process of loading long rail 102*a* is repeated, eventually each loading pocket 354 on the lowermost rail rack 324 is rotated into the rail supporting configuration 348. This process is repeated for each rail rack 324 until all of the loading pockets 354 have been loaded from bottommost to topmost rail racks 324.

Dependent upon the length of rail transport train 300, each rail pocket 354 may have sufficient length to accommodate a series of long rail 102*a* that are joined together on work car 404 to create a continuous long rail string 104 as previously discussed. For example, elevated gantry 702*a* can pick up and load long rail 102*a* as previously described. As elevated gantry 702*a* traverses the rail transport train 300, a distal end 106*a* of the long rail 102*a* may be loaded prior to a proximal end 106*b* reaching the end of the rail transport train 300. In this scenario, distal end 106*a* is held and retained within rail positioning box 566*b* on work car 404 as elevated gantry 702*a* releases the long rail 102*a*. Elevated gantry 702*a* traverses the length of the rail transport train 300 and work unit 400 whereby a second length of long rail 108 can be accessed and grabbed with the gantry boom 730. Elevated gantry 702*a* pulls the second length of long rail 108 onto the work unit 400 whereby an end of the long rail 108 is placed in rail positioning box 566*a* on work car 404. Using rail positioning box 566*a* and rail positioning box 566*b*, long rail 108 is positioned proximate distal end 106*a* over the workstation 548. Long rail 102*a* and second length of long rail 108 can then be joined to form the long rail string 104. Once long rail 102*a* and second length of long rail 108 are joined, elevated gantry 702*a* pulls the long rail string 104 to continue loading the loading pocket 354. When proximal end 106*b* approaches the bulkhead assembly 356 at the end of rail transport train 300, long rail string 104 is fastened and positioned within the rail pocket 337 using the rail tie down 352 on rail clamp car 316. Depending upon the length of rail transport train 300, the process of joining segments of long rail to form long rail string 104 may be repeated a plurality of times before long rail string 104 has sufficient length to occupy the rail pocket 337.

Once the rail pockets 54 are fully loaded, rail transport train 300 can be transported to another location whereby the various long rails can be disposed of, recycled and/or repaired. Rail transport train 300 can be transported under the power of the integrated power plant 200 whereby the entire long rail pick-up and delivery system 100 is transported or rail transport train 300 can be transported by a standard freight engine.

In an alternative configuration, the long rail pick-up and delivery system 100 can be used to transport new lengths of long rail from a shipping hub or foundry to a work site whereby the new long rail can be unloaded for installation at the work site. As mentioned previously, rail transport train 300 in a loaded configuration can be separately hauled to a work site by a standard train engine or the long rail pick-up and delivery system 100 can transport the rail to the work site. In the event that rail transport train 300 is transported to a work site under power of a standard train engine, the rail transport train 300 is attached to the transition car 406. In the event that rail transport train 300 has been separately transported to the work site apart from the work unit 400, expansion beam assemblies 706 are placed between the transition car gantry lanes 608*a*, 608*b* and the rail car gantry lanes 372*a*, 372*b* to form the continuous gantry lanes 704*a*, 704*b*.

To unload long rail 102*a* from the rail transport train 300, elevated gantry 702*a* using the gantry boom 730 grasps long rail 102*a* from one of the uppermost rail pockets 354. Elevated gantry 702*a* traverses the continuous gantry lane 704*a* such that the elevated gantry 702*a* moves from the rail transport train 300, across the work unit 400 and stops atop the chute car 402. As the elevated gantry 702*a* traverses the work unit 400, the long rail 102*a* is positioned in the various rail guides including adjustable rail guide 618*a*, rail guide 616, rail capture assembly 564*b*, rail capture assembly 564*a*, rail guide 444 and either rail guide 418*a* for over the end unloading or through rail capture assembly 486 for unloading alongside the rail bed. Gantry boom 730 positions the long rail 102*a* onto the ground and the gripper head 818 releases the long rail for end of car unloading, or gantry boom 514 can position long rail 102*a* through the open section 416*a* for between the axle unloading whereby the hydraulic guide 420*a* can be used to assist in placing the long rail 102*a* on the ground. Once the end of long rail 102*a* is on the ground, either via end of car unloading or between the axle unloading, the diesel locomotive 202 directs the long rail pick-up and delivery system 100 in a reverse direction such that rail transport train 300 and work unit 400 are backed out from under the long rail 102*a* such that the long rail 102*a* resides on the ground. This process is repeated for each long rail stored on the rail transport trail 300 until each loading pocket 354 is unloaded. As the long rail is being unloaded, plow member 532 can be directed against the surface of the rail bed using vertical actuator 538 and horizontal actuator 540 so as to plow a flaw landing area for placement of the long rail 102*a*. While the unloading process has been described with respect to elevated gantry 702*a*, it is to be understood that elevated gantry 702*b* is capable of simultaneously and independently offloading long rail 102*b* from the rail transport train 300. Once the rail pockets 354 are unloaded, rail transport train 300 can be taken away to load additional long rails.

Figure 35:
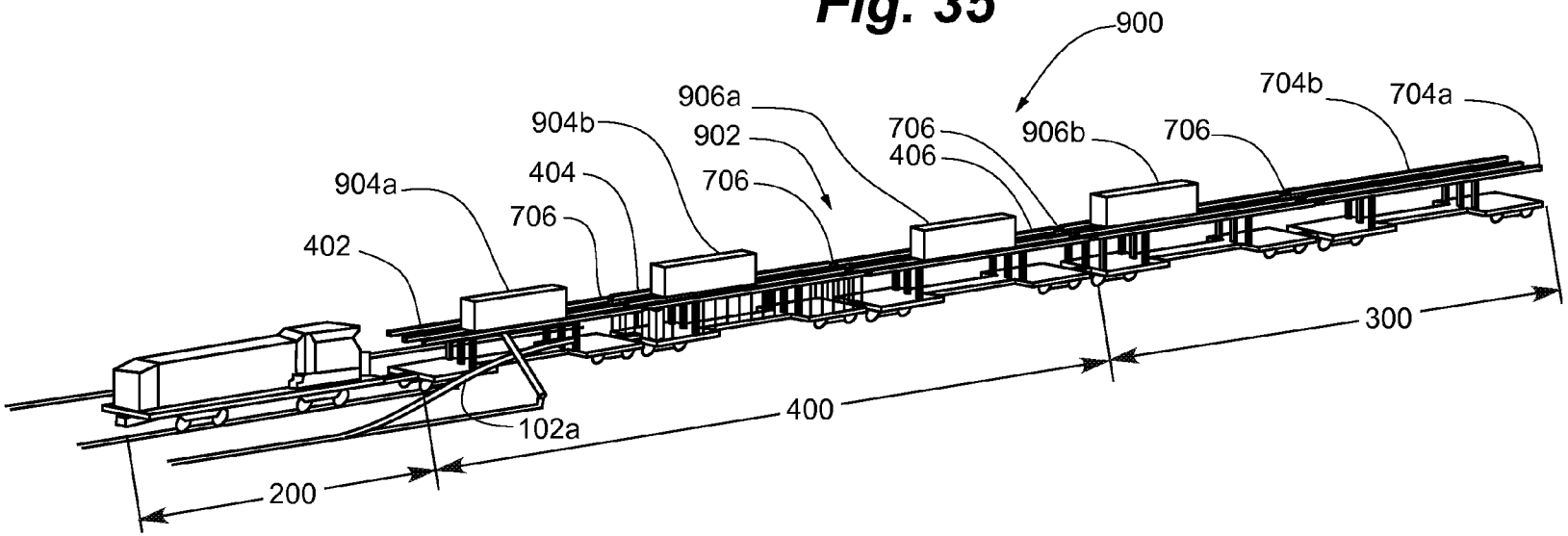
FIG. 35 is an embodiment of a long rail pick-up and delivery system having a dual elevated gantry system.

An alternative embodiment of a long rail pick-up and delivery system 900 is illustrated in FIG. 35. Long rail pick-up and delivery system 900 resembles long rail pick-up and delivery system 100 as both systems include integrated power plant 200, rail transport train 300 and work unit 400. However, long rail pick-up and delivery system 900 differs from long rail pick-up and delivery system 100 with the inclusion of a duplicate gantry system 902. As shown in FIG. 9, duplicate gantry system 902 comprises a pair of front gantries 904*a*, 904*b* and a pair of rear gantries 906*a*, 906*b* operating along gantry lanes 704*a*, 704*b*. Front gantries 904*a*, 904*b* and rear gantries 906*a*, 906*b* are substantially similar to elevated gantries 702*a*, 702*b*.

With respect to operation of the long rail pick-up and delivery system 900, description is made with reference to front gantry 904*a* and rear gantry 906*a* though it will be understood that front gantry 904*b* and rear gantry 906*b* operate similarly along gantry lane 704*b*. In general, loading and unloading of long rail 102*a* is generally performed in a similar matter as previously described with respect to long rail pick-up and delivery system 100. For example, in loading long rail 102, an operator of front gantry 904*a* present in the operator cab 732 manipulates the gantry boom 730 and gripping head 818 to grasp and hold the long rail 102*a*. Using gantry boom 730, the front gantry 904*a* pulls the long rail 102*a* through the work unit 400 as previously described and positions the long rail 102*a* in the desired rail pocket 354. Once positioned in the rail pocket 354, rear gantry 906*a* can grasp the long rail 102*a* and beings pulling the long rail 102*a* down the length of rail transport train 300. At the same time, front gantry 904*a* proceeds in an opposite direction toward the chute car 402 in preparation for grabbing and loading the next length of long rail. In the instance where long rail 102*a* is shorter than the rail transport train 300, rear gantry 906*a* can pull the long rail 102*a* such that one end is at rail positioning box 566*b* on the work car 404 while the front gantry 904*a* grabs and positions an end of the next long rail length at rail positioning box 566*a* such that long rail string 104 can be formed by joining the long rails at workstation 548. With the use of front gantry 904*a* and rear gantry 906*a*, operation efficiency can be achieved by providing bi-direction functionality for the duplicate gantry system 902. Similarly to the described loading operation, duplicate gantry system 902 can be employed to unload long rail 102*a*.

Figure 36:
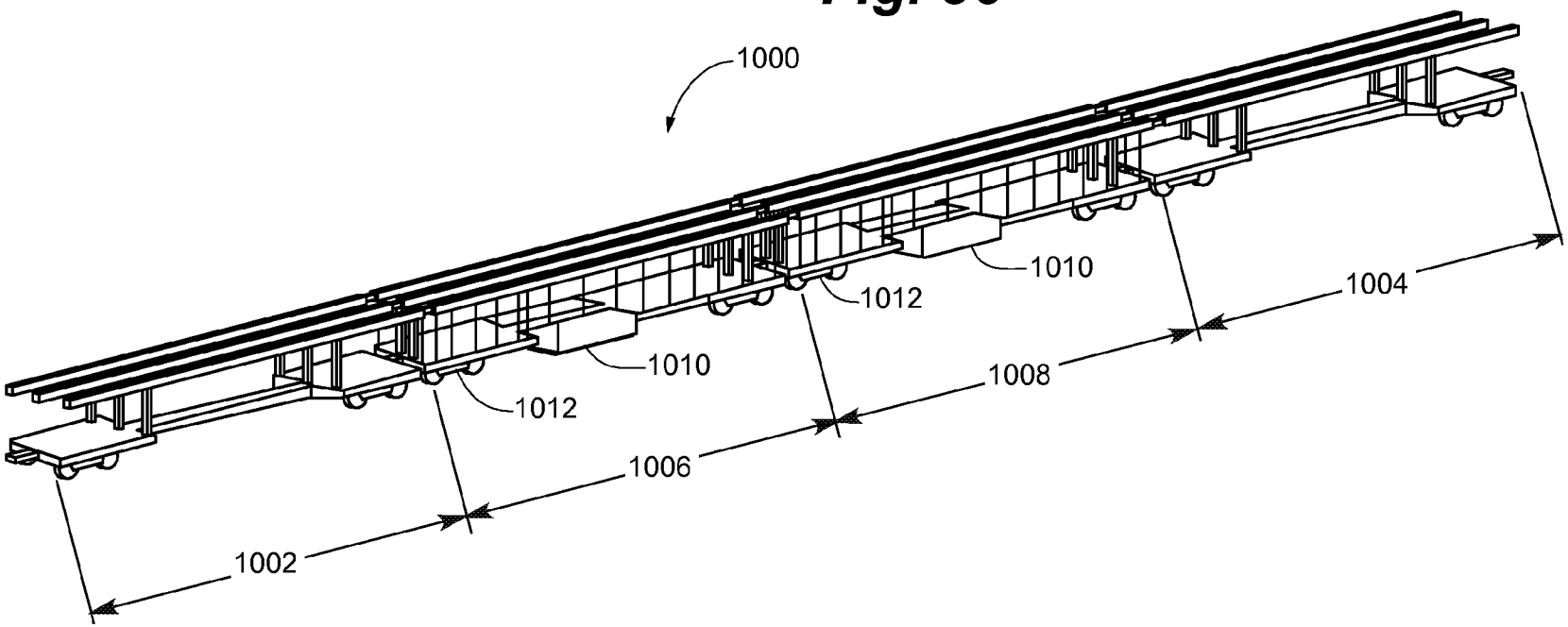
FIG. 36 is an embodiment of a work unit having a pair of work cars with underslung engines and powered bogies.

In an alternative configuration, a work unit 1000, as shown in FIG. 36, can be used so as to eliminate the necessity of integrated power plant 200 and to provide bi-directional function. Work unit 1000 comprises a first chute car 1002 and a second chute car 1004 at opposite ends of the work unit 1000. First chute car 1002 and second chute car 1004 substantially resemble chute car 402 and both are capable of providing the function of transition car 406. Work unit 1000 further comprises a first work car 1006 and a second work car 1008. First work car 1006 and second work car 1008 each include an underslung engine 1010 and a powered bogie 1012. In addition, first work car 1006 and second work car 1008 each include the fist pair of rail positioning systems 566*a*, 566*b* and second pair of rail positioning system 568*a*, 568*b* as previously described with respect to work car 404. The first pair of rail positioning systems 566*a*, 566*b* and second pair of rail positioning systems 568*a*, 568*b* fixes the position of the rail relative to workstation 548 on the first work car 1006 and second work car 1008. Through the inclusion of underslung engine 1010 on both the first work car 1006 and second work car 1008, the traction previously supplied by powered car 200 is no longer required. In one embodiment, the operation of first work car 1006 and second work car 1008 is controlled remotely, for example from an operator in overhead gantry 702*a* or by an operator alongside the railbed.

Although various embodiments of the present invention have been disclosed here for purposes of illustration, it should be understood that a variety of changes, modifications and substitutions may be incorporated without departing from either the spirit or scope of the present invention.

What is claimed:

1. A long rail pick-up and delivery system comprising:

a rail transport portion comprising at least one rail transport subset, the rail transport subset comprising a plurality of rail cars wherein each rail transport car has a rail rack system, the rail rack system having a pair of parallel rack systems, each parallel rack system comprising a plurality of rack support members rotatably attached to a central rack support and rotatably engageable with an exterior rack support, the rail rack system defining a plurality of aligned rail pockets along the length of the rail transport portion and wherein the rail transport portion has an elevated rail transport track;

a work portion comprising a rail positioning car, a rail work car and a rail transition car and wherein the work portion comprises an elevated work track; and an elevated gantry system having a pair of elevated gantries, each gantry comprising a telescoping boom with a gripper assembly for grasping a length of long rail, each elevated gantry traversing the elevated rail transport track and the elevated work track so as to selectively load and unload long rail from the rail pockets.

2. The long rail pick-up and delivery system of claim 1, further comprising:

at least one power car coupled to the work portion for transporting the long rail pick-up and delivery system to a work site.

3. The long rail pick-up and delivery system of claim 2, wherein the at least one power car comprises a diesel locomotive.

4. The long rail pick-up and delivery system of claim 1, wherein the at least one rail transport subset comprises a pair of end rail cars and a clamping rail car.

5. The long rail pick-up and delivery system of claim 4, wherein the at least one rail transport subset comprises a plurality of storage rail cars such that the clamping rail car resides in a middle position within the rail transport subset.

6. The long rail pick-up and delivery system of claim 1, wherein the central rack support and the exterior rack supports provide support to the elevated rail transport track.

7. The long rail pick-up and delivery system of claim 1, wherein the rack support members comprise a rail interface assembly for defining the plurality of aligned rail packets, each rail interface assembly selected from the group comprising: a roller assembly and a tie down assembly.

8. The long rail pick-up and delivery system of claim 1, wherein each elevated gantry further comprises an operator station, an engine and a track interface such that each elevated gantry independently traverses the elevated rail transport track and the elevated work track.

9. The long rail pick-up and delivery system of claim 8, wherein the track interface comprises a wheel assembly having a pair of opposed wheels such that the wheels interface with opposed sides of the elevated rail transport track and the elevated work track.

10. The long rail-pick up and delivery system of claim 9, wherein at least one of the opposed wheels comprises a polyurethane wheel so at to increase a frictional interface between the wheel assembly and the opposed sides of the rail transport track and the elevated work track.

11. The long rail pick-up and delivery system of claim 1, further comprising:

a plurality of expansion tacks operatively interconnecting the elevated rail transport track and the elevated work track to define a pair of continuous gantry lanes extending the length of the rail transport portion and the work portion, expansion tracks being positioned between each rail car, the rail positioning car, the rail work car and the rail transition car.

12. The long rail pick-up and delivery system of claim 11, wherein each expansion track comprises a pair of expansion members slidably attached such that lateral expansion along each gantry lane is accommodated through slidable translation of the expansion members without affecting the continuity of the gantry lanes.

13. The long rail pick-up and delivery system of claim 11, wherein the expansion members are removably attached to form the gantry lane such that the expansion members can be removed during transport to a job site.

14. The long rail pick-up and delivery system of claim 1, wherein the rail positioning car comprises a pair of rail manipulators attached on opposed sides of the rail positioning car, each rail manipulator comprising a manipulating arm and a rotator box wherein the rotator box fixedly captures a rail while the manipulating arm positions the rail proximate the rail positioning car.

15. The long rail pick-up and delivery system of claim 14, wherein the rotator box is rotatably attached to the manipulating arm such that the rotator box is positianable in a capture configuration within a range of 90 degrees either side of vertical so as to capture the rail without regard to a rail orientation.

16. The long rail pick-up and delivery system of claim 15, wherein the rotator box comprises a remotely actuated clamp assembly, the remotely operated clamp assembly being actuated to an open disposition prior to rail capture and being actuated to a closed disposition following rail capture.

17. The long rail pick-up and delivery system of claim 14, wherein the manipulating arm is pivotally attached to the rail positioning car and wherein a linear actuator operatively mounted between the rail positioning car and the manipulating arm positions the rotator box at a selected distance from the rail positioning car both before and after rail capture.

18. The long rail pick-up and delivery system of claim 1, wherein the rail positioning car comprises a pair of rail plows, each rail plow being selectively vertically positionable such that a plow member on each rail plow is engageable with track ballast along a rail line such tat the plow member forms a positioning area in the track ballast for laying long rail along the rail line.

19. The long rail pick-up and delivery system of claim 1, wherein the work car comprises at least one operator work station for performing work on the long rail; the at least one operator work station is selected from the group comprising: a cutting station, a drilling station, a welding station and a bolting station.

20. The long rail pick-up and delivery system of claim 19, wherein the work car comprises a first rail positioning box and a second rail positioning box, each rail positioning box being operably mounted on a positioning track and having a positioning clamp assembly for retainably grasping long rail wherein the first rail positioning box and the second rail positioning box cooperatively position long rail at the at least one operator work station.

21. The long rail pick-up and delivery system of claim 1, wherein the work car comprises at least one operator room such that a system operator is protected during loading and unloading of the long rail.

22. A method for loading long rail on a rail storage train comprising:

positioning a rail transport system adjacent long rail residing on a rail bed, the rail transport system including a plurality of rail cars;

grasping a first length of long rail with a first gantry boom attached to a first elevated gantry and grasping a second length of long rail with a second gantry boom attached to a second elevated gantry; and traversing the plurality of rail cars with both the first elevated gantry and the second elevated gantry, the first elevated gantry and the second elevated gantry providing for simultaneous loading of the first length and the second length of long rail along the length of the rail transport system.

23. The method of claim 22, further comprising:

orienting the first and second lengths of long rail with a rail manipulator such that the first and second lengths of long rail are aligned for loading.

24. The method of claim 22, further comprising:

aligning the first and second lengths of long rail with a rail positioning device, the rail positioning device having horizontal and vertical adjustment for directing the first and second lengths of long rail along a rail pockets defined along the length of the rail transport system.

25. The method of claim 24, further comprising:

clamping the first and second lengths of long rail into a fixed position within the rail pockets.

26. A method for unloading long rail from a rail storage train comprising:

delivering a loaded rail storage train to a work site, the loaded rail storage train including a work portion and a rail storage portion loaded with long rail;

grasping a first length of long rail with a first overhead gantry and grasping a second length of long rail with a second overhead gantry wherein the first overhead gantry and the second overhead gantry operate in parallel relation along the rail storage train;

driving the first and second overhead gantries along first and second elevated gantry lanes such that both the first and second overhead gantries move from above the rail storage portion to above the work portion;

positioning a first end of a first length of long rail along a rail bed with a first boom on the first overhead gantry and positioning a second end of a second length of long rail along the rail bed with a second boom on the second overhead gantry; and directing the rail storage train away from the end of the long rail such that the first and second lengths of long rail are simultaneously unloaded from the rail storage train onto the rail bed.

27. The method of claim 26, further comprising:

anchoring the first end of the first length of long rail and the second end of the second length of long rail to previously positioned long rail along the rail bed.

* * * * *